US005098311A

United States Patent [19]

Roath et al.

[11] Patent Number: 5,098,311

[45] Date of Patent: Mar. 24, 1992

[54] HERMAPHRODITIC INTERCONNECT SYSTEM

[75] Inventors: Alan L. Roath, Madison; James A. Bacnik, Mentor; John T. Venaleck, Madison; Howard J. Venaleck, Painesville, all of Ohio

[73] Assignee: Ohio Associated Enterprises, Inc., Painesville, Ohio

[21] Appl. No.: 365,011

[22] Filed: Jun. 12, 1989

[51] Int. Cl.[5] ..... H01R 13/28

[52] U.S. Cl. ..... 439/289; 439/65; 439/78; 439/79; 439/290; 439/291

[58] Field of Search ..... 439/66, 74, 76, 79, 439/80, 284, 286, 289-293, 295, 374

[56] References Cited

U.S. PATENT DOCUMENTS

| | | | |
|---|---|---|---|
| 3,011,143 | 11/1961 | Dean | 439/291 |
| 3,634,811 | 1/1972 | Teagno et al. | 439/290 |
| 4,482,937 | 11/1984 | Berg | 439/65 |
| 4,688,866 | 8/1987 | Legrady | 439/78 |
| 4,732,565 | 3/1988 | Ito et al. | 439/79 |
| 4,734,060 | 3/1988 | Kawawada et al. | 439/295 |
| 4,737,118 | 4/1988 | Lockard | 439/289 |
| 4,820,182 | 4/1989 | Harwath et al. | 439/291 |
| 4,836,799 | 6/1989 | Tomer | 439/284 |

FOREIGN PATENT DOCUMENTS 7506013 12/1975 Netherlands ..... 439/291

OTHER PUBLICATIONS

Shimada et al., "A New 50 Mil Pitch Connector System", International Institute of Connector and Interconnection Technology, Inc., 21st Symposium, Oct., 1988, p. 120.

Robinson Nugent Pak-50 Advertisement in EE Product News, Mar., 1989.

A P Products Incorporated Literature, "Low-Profile Edge-Board Connector".

*Primary Examiner*—Paula A. Bradley

*Attorney, Agent, or Firm*—Watts Hoffmann Fisher & Heinke

[57] ABSTRACT

An electrical interconnect system employs electrical connectors in which both the housing (or support) and the contact(s) thereof are hermaphroditic, i.e., without gender limitations. Therefore, two such connectors may interconnect with each other. Contacts are arranged in a header or other housing or support in which at least two contacts, for example, adjacent contacts, respectively face in opposite directions. Bifurcated and trifurcated contacts have contacting portions respective ones of which face in opposite directions and are supported on parallel cantilever arms.

32 Claims, 9 Drawing Sheets

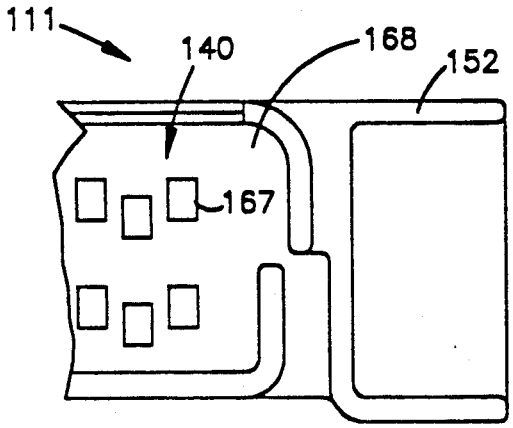
FIG.21
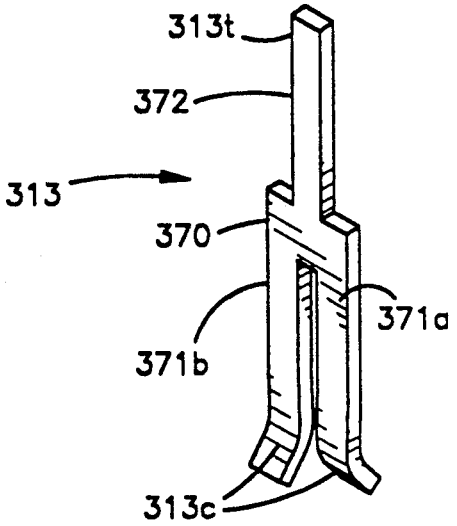
FIG.23
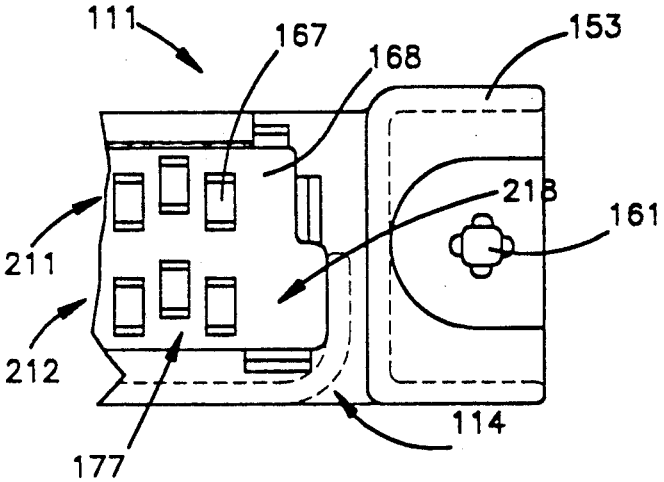
FIG.22
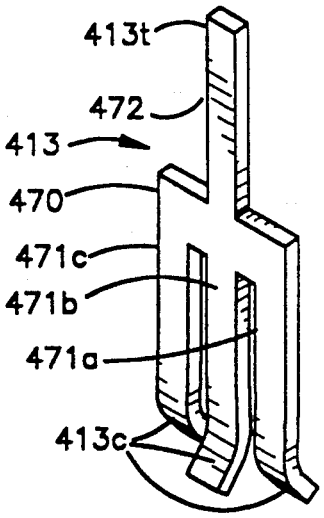
FIG.24
FIG.25
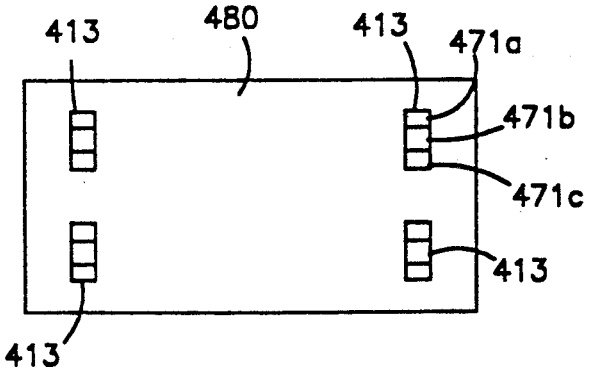

HERMAPHRODITIC INTERCONNECT SYSTEM

TECHNICAL FIELD

This invention relates generally, as is indicated, to electrical connectors and interconnection systems, and, more particularly, to systems for electrical interconnection that are not gender sensitive.

BACKGROUND

Various types of electrical interconnection systems are known. Exemplary interconnection systems include those which are used to connect one or more electrical conductors on one printed circuit board or card to one or more respective electrical conductors on another printed circuit board or card. Other types of exemplary interconnection systems are those used to connect one or more conductors of an electrical cable to one or more respective electrical conductors of another cable, a printed circuit card or board, a terminal, etc. Other types of electrical interconnection systems also are known.

The present invention is useful in a variety of such electrical interconnection environments; however, a preferred embodiment is used as a board to board, i.e., to interconnect the conductors on one printed circuit board with the conductors on another printed circuit board.

A disadvantage encountered in prior board to board interconnection systems has been the relatively large amount of space required for the connectors, both on and between the respective boards, thus consuming space in an apparatus in which the boards are used and the lateral space required on the board, sometimes referred to as real estate. It is desirable to minimize the space requirements for interconnection systems.

Other disadvantages in prior electrical interconnection systems encountered due to contact design include variations in insertion forces, a need for large insertion forces to assure strong electrical connections between contacts, interruption in electrical continuity due to dirt between confronting contact surfaces, wearing of contacts due to sharp burrs and the like on the contact metal, etc.

In conventional non-hermaphroditic electrical connectors for use in various electrical interconnection systems plural parts, one typically being referred to as a male part and one as a female part, had to be designed, engineered, and manufactured. Typically a male electrical connector would have one type of contact and one type of housing; and a female electrical connector would have a different type of electrical contact and housing designed to mate with the male. The housings support the contacts, often provide protection and alignment functions for the contacts, and even guide one connector to connection with the other. Such housings also help to hold themselves and the contacts thereof in electrical interconnection engagement with each other.

The more separate parts required for the electrical interconnection system, the more designing, engineering and manufacturing time, effort, and cost are required to complete the interconnection system and the larger the number of parts typically required for adequate inventory supply.

The housings for conventional electrical connectors often are designed to withstand various forces, such as torques, shears and stresses, which are produced by the contacts. It would be desirable to reduce such forces thereby to reduce the strength requirements for the connector housings.

BRIEF SUMMARY

Briefly, according to the invention an electrical interconnect system employs electrical connectors in which both the housing (or support) and the contact(s) thereof are hermaphroditic, i.e., without gender limitations. Therefore, two such connectors may interconnect with each other.

Another aspect relates to a new arrangement of contacts in a header or other housing or support in which at least two contacts, for example, adjacent contacts, respectively face in opposite directions.

The present invention provides improvements in the arrangement and use of electrical contacts to reduce various forces on the contacts themselves and/or on the support or housing and to improve precision of contact placement.

The present invention provides the ability to interconnect plural circuit boards in face to face relation or other relation, if desired, while minimizing the space requirements for the interconnection system.

The present invention provides improvements in electrical contacts to improve the integrity of electrical connection, to maintain substantially uniform insertion forces, and to minimize premature wear.

The present invention includes techniques that reduce the time, effort and cost to design, to engineer, and to manufacture an electrical interconnection system. Moreover, the invention provides a corollary advantage of minimizing the number of parts required for inventory, on the one hand, while being able promptly to supply requirements of customers, on the other hand.

According to one embodiment of the invention, an electrical interconnection system includes two substantially identical electrical connectors, each including at least one electrical contact for making an electrical connection, a housing for supporting the electrical contact, the housing having a guiding mechanism for guiding the housing into aligned coupled relation with the housing of the other electrical connector to place the respective electrical contacts of the respective electrical connectors in electrical connecting relation.

Another embodiment relates to an hermaphroditic electrical connector including at least one electrical contact for making electrical connection, a support for supporting the electrical contact, means for guiding the electrical contact to connected engagement with an electrical contact of another electrical connector, the means for guiding being formed by a wall, and the wall having an opening therein for receiving a respective wall section of such another electrical connector to permit nested overlying connected placement of the wall and such respective wall section when the electrical connector is connected to such another electrical connector. Further, preferably both electrical connectors are hermaphroditic and most preferably are identical.

According to a further embodiment, an hermaphroditic electrical connector includes electrical contacts for making electrical connection, a support for supporting the electrical contacts, means for holding the electrical connector in connected engagement with another electrical connector with the electrical contacts in connected engagement with electrical contacts of such another electrical connector, the means for holding including a wall which has an opening therein for receiving a respective wall section of such electrical connector to permit nested overlying connected placement of the wall and such respective wall section when the electrical connector is connected to such another electrical connector. Further, preferably both electrical connectors are hermaphroditic and most preferably are identical.

Yet another embodiment relates to a housing for an electrical connector including a support for supporting at least one electrical contact, and a shell at least partly coextensive with and at least partly surrounding at least part of such electrical contact, the shell including a guide for guiding such electrical connector to connected engagement with another electrical connector having a substantially identical guide, and the guide including an opening for receiving at least part of the guide of such another electrical connector to permit a generally nested connection of such electrical connectors.

Yet an additional embodiment relates to a shell for an electrical connector that includes at least one electrical contact and a support for such electrical contact, including a wall at least partly coextensive with and at least partly surrounding at least part of the at least one electrical contact, the wall including a guide for guiding such electrical contact to connected engagement with an electrical contact of another electrical connector having substantially the same configuration of wall, and the wall including an opening for permitting positioning of such wall of such another electrical connector in a generally nested connection relationship with the wall of the first-mentioned electrical connector.

Another embodiment of the invention concerns an electrical connector that includes a housing including a base, a shell peripherally about at least part of the base, and an opening in the base, and a header unit including at least one electrical contact in a support, the header unit being positioned in the opening to position at least part of the contacting portion of the contact in an area generally protected by the shell.

A further embodiment concerns an electrical connection device or system that includes plural electrical contacts arranged in a row, each contact including a base and a contacting portion, a support for supporting the electrical contacts at the base, the contacting portion including a cantilever arm protruding from the base and a curved contacting surface area at the distal end of the cantilever arm for contacting with a contact of similar configuration, and wherein the curved contacting surface area of respectively adjacent electrical contacts face in respectively opposite directions. A still further embodiment employs such device or system in an electrical connector, especially in an hermaphroditic interconnection system.

An aspect of the invention relates to an electrical connector including plural electrical contacts arranged in a row, each contact including a base, a terminal portion, and a contacting portion, a support for supporting the electrical contacts at the base, the contacting portion including a contacting surface area for contacting with a contact of another electrical connector, the terminal portion including a surface area extending angularly relative to the base for electrically connecting with a terminal of a printed circuit board or the like. In addition the contact terminal portion may include an arm which contains the mentioned surface area, and a mounting mechanism holds the support to such printed circuit board to place the mentioned surface area into engagement with such circuit board terminal, for example, for attachment thereto compatibly with surface mount processing.

Even a further embodiment relates to a board to board interconnection system, including a plurality of circuit boards, and a substantially identical electrical connector mounted on each of the circuit boards, each electrical connector including electrical contacts for making an electrical connection, a housing for supporting the electrical contacts, the housing having guiding means for guiding the housing into aligned coupled relation with the housing of the other electrical connector to place the respective electrical contacts of the respective electrical connectors in electrical connecting relation.

According to a further aspect of the invention, a bifurcated contact includes a base and a contacting portion, said contacting portion including a pair of cantilever arms protruding from said base and extending generally in parallel, and a curved contacting surface area at the distal end of each of said cantilever arms for contacting with an external member inserted to engagement therewith, and wherein the contacting portions of the pair of cantilever arms respectively face in opposite directions.

According to still a further aspect, a trifurcated contact includes a base and a contacting portion, the contacting portion including at least three cantilever arms protruding from the base and extending generally in parallel, and a curved contacting surface area at the distal end of each of the cantilever arms for contacting with an external member inserted to engagement therewith, and wherein the contacting portions of at least two cantilever arms face in one direction and the contacting portion of a cantilever arm located between the at least two cantilever arms face in the opposite direction.

According to even a further aspect, an electrical apparatus includes an electrical device containing circuitry, plural electrical contacts directly mounted to such electrical device for mechanically connecting and electrically connecting said electrical device with another member, each electrical contact including a base and a contacting portion, and the contacting portion including a cantilever arm protruding from the base and a curved contacting surface area at the distal end of the cantilever arm for contacting with an external member inserted to engagement therewith.

Various other features of the invention, as are described herein, may be employed in a board to board interconnection system and in cable to board, cable to cable, etc., interconnection systems.

The foregoing and other objects, features, aspects and advantages of the present invention will become more apparent as the following description proceeds. It will be appreciated that while several embodiments of the invention are described herein, the scope of the invention is to be determined by the claims and equivalents thereof. Also, although several embodiments having different features are shown and various features are shown in the several drawing figures, it will be appreciated that various features shown in one drawing figure and/or with respect to a particular embodiment often may be employed in other embodiments.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be suitably employed.

BRIEF DESCRIPTION OF THE DRAWINGS

In the annexed drawings:

FIG. 21 is a fragmentary top view of the right-hand portion of the connector of FIG. 15, the contacts being omitted for clarity of illustration of the housing;

FIG. 22 is a fragmentary bottom view of the connector of FIG. 15, the contacts being omitted for clarity of illustration of the housing;

FIG. 23 is a schematic isometric view of a bifurcated contact according to the invention and useful in the several embodiments disclosed herein;

FIG. 24 is a schematic isometric view of a trifurcated contact according to the invention and useful in the several embodiments disclosed herein; and FIG. 25 is a schematic top plan view of a circuit board having mounted therein plural trifurcated contacts of the type illustrated in FIG. 24.

DETAILED DESCRIPTION OF THE INVENTION

Figure 1:
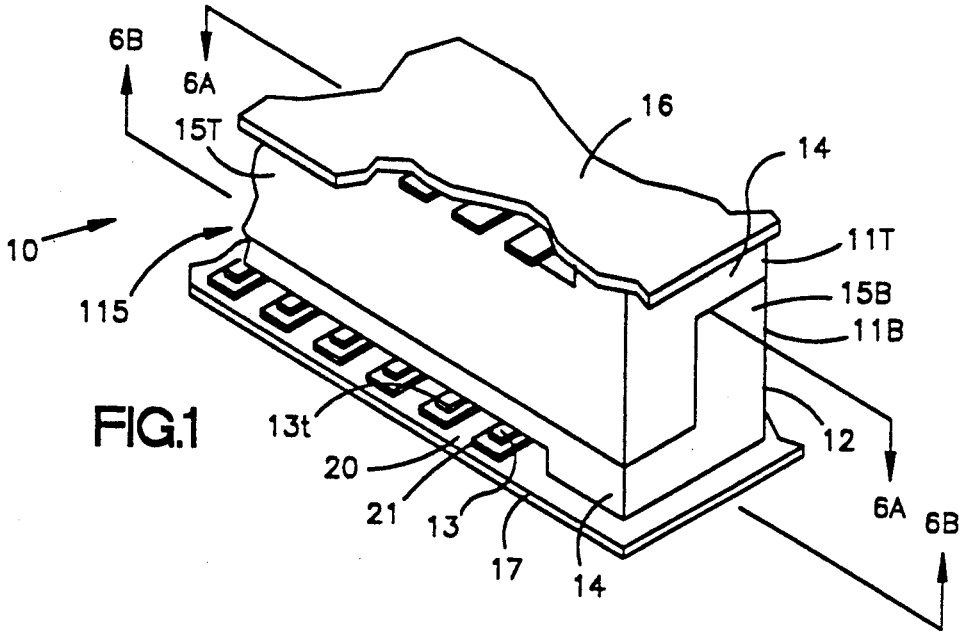
FIG. 1 is a schematic fragmentary isometric view of a board-to-board interconnection system in accordance with the preferred embodiment and the best mode of the present invention (portions of the ends of the connectors have been omitted for simplicity of the illustration)

Referring in detail to the drawings, wherein like reference numerals designate like parts in the several figures, and initially to FIG. 1, an hermaphroditic board to board interconnect system is generally indicated at 10. The system 10 includes a pair of hermaphroditic connectors 11T and 11B, which form an hermaphroditic interconnect system 11S. The suffix letters T and B respectively designate the connectors that are at the top and bottom of the interconnect system 11S. As will be appreciated from the description below, the connectors 11T and 11B preferably are identical or at least are substantially identical. Also, in the following description comments concerning the connector 11 without a suffix are applicable to both connectors, and unless otherwise indicated by the context or otherwise explicitly mentioned, comments concerning either connector generally are applicable to both connectors.

As will be evident from the description herein, the connectors 11T, 11B are interchangeable. Reference to top and bottom relationship or other directions are with respect to the drawings and used only for convenience of description. Other directional orientations or positioning of the connectors 11T, 11B also may be employed in accordance with the present invention. For example, the connectors 11T, 11B may be oriented in side by side relation.

As is seen in FIG. 1, each connector 11T, 11B includes a housing 12 and one or more contacts 13. The contacts 13 of the respective connectors 11T, 11B connect with each other in the respective housings 12T, 12B. The connector housing 12 has a base 14 and an upstanding shell 15. The connectors 11T, 11B are able to be coupled together in a nested arrangement by the interconnecting relationship of the respective shells 15 thereof. Each of the connectors 11T, 11B is connected via the contacts 13 and base 14 thereof to a respective circuit board 16, 17.

On the surface 20 of each circuit board are printed circuit paths, traces or the like, including respective solder pads 21, for example. Terminal portions 13*t* of contacts 13 of the connectors 11T, 11B are electrically connected to respective solder pads 21 of the circuit boards 16, 17.

In the illustration of FIG. 1, the hermaphroditic interconnect system 11S is employed in a board to board interconnect system 10. With the connectors 11T, 11B electrically and mechanically connected to each other and respectively electrically and mechanically coupled to the circuit boards 16, 17, mechanical and electrical connection of the circuit boards 16, 17 to each other is achieved.

Figure 2:
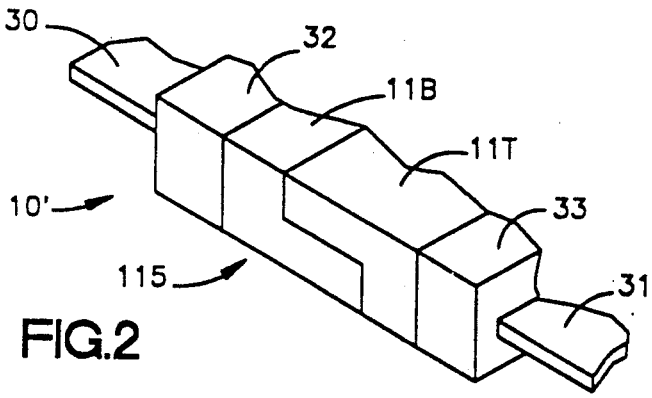
FIG. 2 is a schematic fragmentary isometric view of a cable-to-cable interconnection system in accordance with an alternate embodiment of the invention (portions of the ends of the connectors have been omitted for simplicity of the illustration)

The hermaphroditic interconnect system 11S may be employed in a cable to cable interconnect system 10' of FIG. 2. In such system 10', the hermaphroditic connector system 11S is used to provide electrical connection between respective electrical cables 30, 31. Such cables may be single conductor cables, multiconductor cables, ribbon cables, etc., which are well known. Conventional techniques, such as soldering, insulation displacement connection (IDC) or other techniques, may be employed to connect the conductor(s) of each cable to the respective contacts 13 of the connectors 11T, 11B. Also, conventional strain relief devices 32, 33 may be employed to provide mechanical connection of the respective cables 30, 31 to the respective connectors 11T, 11B thereby to avoid applying forces to the junctions of respective cable conductors and contacts during connecting, disconnecting and use of the system 10'. Since the connections of the cable conductors to the connector contacts and the strain relief may be of conventional type, e.g., as those disclosed in the patent and other published literature, detailed description and illustration thereof is not presented; however, appropriate techniques will be evident to those having ordinary skill in the art.

Figure 3:
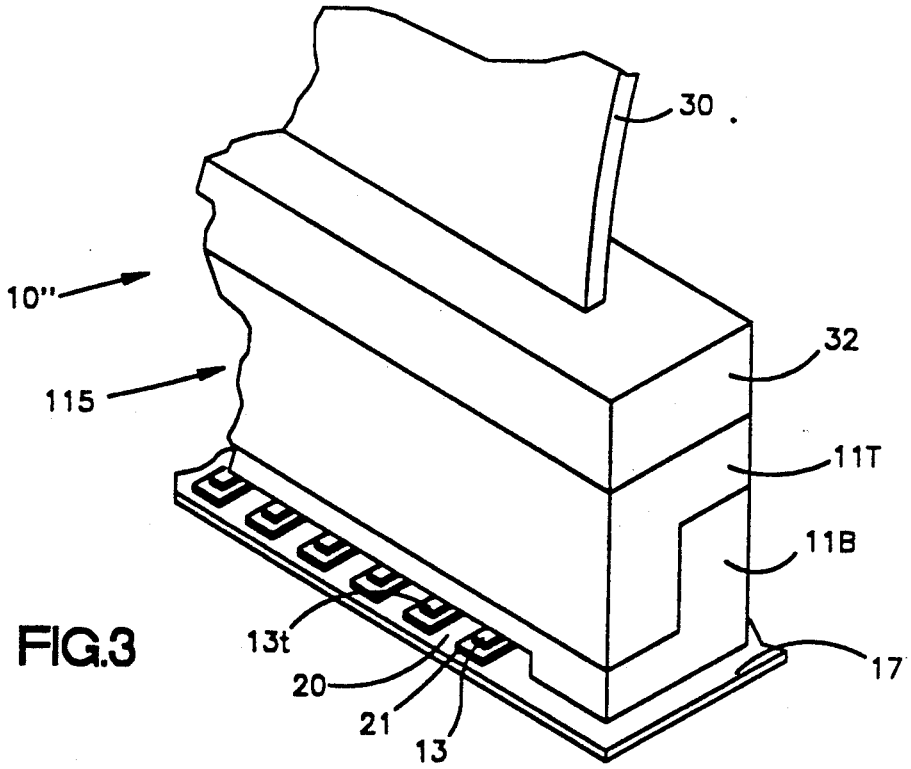
FIG. 3 is a schematic fragmentary isometric view of a cable-to-board interconnection system in connection with another alternate embodiment of the invention (portions of the ends of the connectors have been omitted for simplicity of the illustration)

Referring briefly to FIG. 3, an hermaphroditic cable to board interconnect system 10' is illustrated. Such system 10' includes an hermaphroditic interconnect system 11S having a top connector 11T and a strain relief 32 coupled to an electrical cable 30 and having a bottom connector 11B coupled to solder pads 21 on the surface 20 of a circuit board 17. The hermaphroditic cable to board interconnect system 10' of FIG. 3 uses the hermaphroditic interconnect system 11S to provide electrical connections between respective conductors of the cable 30 to respective solder pads 21 and circuits associated therewith on the circuit board 17.

Although three examples of use of the hermaphroditic interconnect system 11S are illustrated in FIGS. 1 through 3 and are described above, it will be appreciated that the hermaphroditic interconnect system 11S may be utilized in other environments, systems, etc., as will be evident to those having ordinary skill in the art. Another such example may include an edge connector version of the invention wherein the contact terminal portions 13*t* are generally straight to couple to printed circuit terminal pads at the edge of a circuit board.

Ordinarily, an electrical connector includes one or more electrical contact(s) and a mechanism to support such contact(s) for carrying out the function of making an electrical connection with another electrically conductive member, contact, etc. In the present invention the primary mechanism for providing the support for the one or more contacts is referred to as a housing. Such housing primarily is formed of electrically nonconductive material. However, if desired, the housing may be formed of eletrically conductive material and/or combination of electrically conductive and nonconductive materials with appropriate electrical insulation provided as needed. For example, a plastic nonconductive housing may be plated with metal, such as zinc, as is known. Such support mechanism will be referred to as a housing hereinafter. However, it will be appreciated that other types of support mechanism also may be employed in accordance with the present invention. Moreover, in the present invention the electrical contacts 13 are of a specific shape and form. It will be appreciated, however, that although a preferred form of electrical contact is disclosed herein, other types of electrical contacts or other electrically conductive members to make electrical connections may be employed within the spirit and scope of the present invention.

The connector housing 12 may be made using conventional plastic injection molding techniques. Such housing may be formed, for example, of glass-filled liquid crystal polymer Other means may be employed to form the connector housing and/or the contacts employed therein than those techniques disclosed in detail herein.

Also, the preferred embodiment of the present invention uses a header connector to provide the contacts for the connector housing. However, other arrangements of contacts supported in, by and/or with respect to the connector housing may be used in practicing the present invention.

Although the hermaphroditic interconnect system 11S of the present invention utilizes two connectors 11T, 11B, such connectors are not of different respective genders. Rather, the connectors 11T, 11B are identical or substantially identical; yet, the two connectors 11T, 11B are able to be attached to each other mechanically and to achieve desired electrical interconnections between respective contacts thereof. Examples of identical connectors 11T, 11B may be in the systems 10 and 10' of FIGS. 1 and 2. An example of substantially identical, but slightly different, connectors 11T, 11B may be in the cable to board interconnect system 10' of FIG. 3 in which portions of the contacts 13 of the connectors 11T, 11B may be modified to accommodate connections, respectively, with the conductors of cable 30, or with the solder pads 21 of the circuit board 17.

To be hermaphroditic, though, the housings 12 of respective connectors 11 and the contacting portions of the contacts 13 should be the same or substantially the same, and also should be able to fit together to achieve the desired mechanical and electrical interconnections. As is seen in FIGS. 1, 2 and 3, the housings 12T, 12B are the same and fit together in nested, overlying relation with the respective shell walls 15T, 15B cooperatively positioned.

Figure 4A:
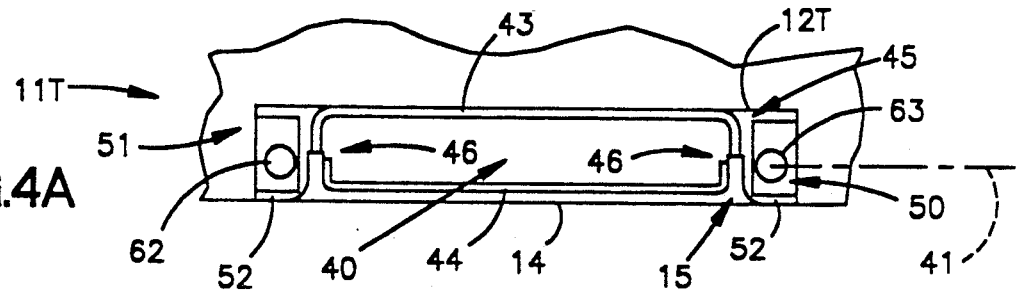
FIGS. 4A and 4B are schematic illustrations, respectively, of the top connector fastened to a circuit board and a bottom connector fastened to a circuit board, as is depicted in FIG. 1, the contacts being omitted for clarity of the connector housing view.
Figure 4B:
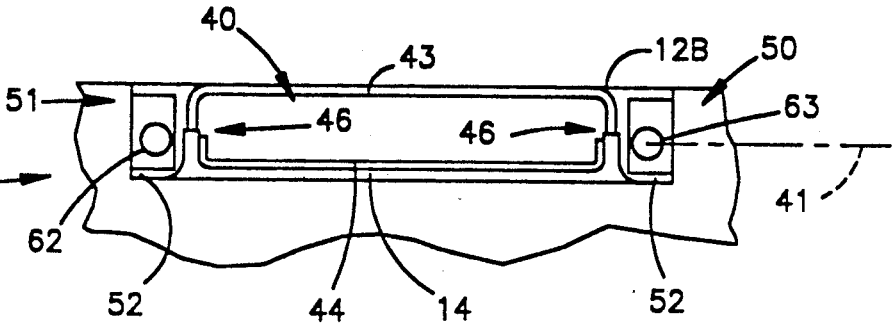
Figure 5:
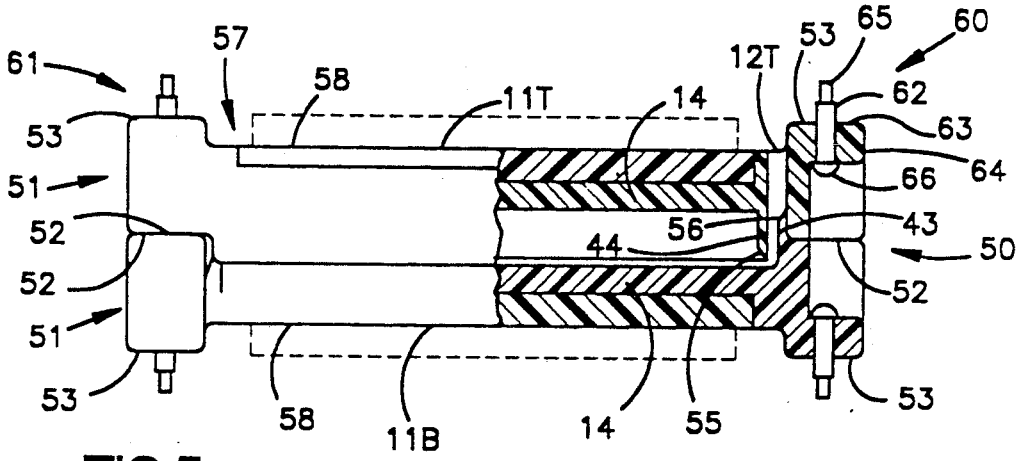
FIG. 5 is a schematic front elevation view, partly broken away in section, of the two connectors of FIGS. 4A and 4B in assembled nested connected relationship, the contacts being omitted for clarity of the connector housing illustration.

Turning to FIGS. 4A, 4B, and 5, the housings 12T, 12B, respectively, for the connectors 11T, 11B of FIG. 1, are illustrated in plan view looking into the electrical contacting zone 40 of each. The contacts 13 are not shown in FIGS. 4A, 4B and 5 to facilitate clearly showing the housings. Such views are referred to as top views; in fact, relative to the illustration of FIG. 1, the illustration of FIG. 4A is looking from the connector 11B up toward the connector 11T, and the illustration in FIG. 4B is looking from the connector 11T down toward the top of the connector 11B. The housings 12T, 12B are identical. By rotating the housing 12B 90 degrees about a horizontal axis, e.g., the centerline axis 41, to face generally in the direction of the connector 11B of FIG. 1 and by rotating the housing 12T 90 degrees in the relatively opposite direction about the horizontal centerline axis 41 thereof so as to face generally in the direction of the housing 11T of FIG. 1, the two housings 12T, 12B may be assembled together in nested attached relation, which is shown more clearly in FIG. 5.

As is seen in FIGS. 4A, 4B and 5, in each housing 12 the shell 15 stands upward from the base 14 and includes two separate wall portions 43, 44. The shell wall portion 43 is an outer protruding or exposed wall in that it is larger than and covers or encloses the relatively recessed or inner wall portion 44 of the opposite connector when two of the connectors 11 are attached together. The wall portions 43, 44 collectively form a wall structure 45 defining the shell 15 of the respective connectors.

The wall structure 45 has a pair of openings 46 between the wall portions 43, 44. Such openings 46 in a sense are slots, gaps, discontinuities, offsets, etc., between the respective wall portions 43, 44. The openings 46 together with the two different size wall portions 43, 44 enable the respective shells 15 of two connectors 11 to be placed into the nested relation illustrated in FIG. 5. The wall portions 43, 44 and the openings 46 therein or therebetween provide the functions of guiding the connectors 11T, 11B and the contacts 13 thereof into aligned engagement and connection, of holding the connectors to and relative to each other, and, preferably, of protecting or enclosing the contacting portions 13*c* (FIG. 7 et al) of the contacts and the contacting zone 40 where the contacting portions of both connectors 11T, 11B are interconnected. If the shell 15 is electrically conductive, it may also provide shielding and/or grounding functions.

Note that the wall portions 43, 44 are "C" shape; such wall portions may be other than "C" shape, may include one or more discontinuities or openings, etc. Such wall portions are designed, though, to nest together generally in the illustrated manner so that the housing 12 of the connector 11 has attributes of an hermaphroditic connector. Openings 46 preferably extend from the distal or far edge of each wall 43 and 44 down to the base 14 but may be of a shallower depth as long as the confronting opening 46 in a mating connector is of adequate depth to achieve the desired interconnected insertion of the shell 15 of one connector 11T, for example, into the shell of the other connector, 11B, for example. Also, more than two openings 46 and a staggering of walls 43, 44 therebetween may be employed. The left-hand and right-hand (relative to FIG. 5, for example) end or wing portions 50, 51 of the connector housings 12T, 12B are illustrated in FIGS. 4A, 4B and 5, although for simplicity of illustration they are not shown in FIGS. 1-3. Each wing portion includes an internal abutment surface 52 and an external abutment surface 53. The internal abutment surfaces 52 are surfaces that confront each other when the two connectors 11T, 11B are fastened together in the nested arrangement shown in FIG. 5, thus limiting the extent or depth of penetration of the shell 15 of one connector relative to the shell 15 of the other connector.

The distal or far edges of the shells 15 may be tapered, as is shown by example in FIG. 5 at 55, 56, to facilitate alignment of the respective shells during connecting of the connectors 11T, 11B. (In other examples illustrated such distal edges are flat or curved.) The abutment surfaces 52 may prevent the shell distal edges from engaging a confronting base 14, thereby preventing possible damage to such edges.

The internal abutment surfaces 52 also limit the extent that the contacting portions 13*c* (FIG. 6A, for example) of the contacts 13 of one connector insert toward and engage respective contacts of the other connector. Therefore, when the two connectors 11T, 11B are assembled in fully nested arrangement, such as that illustrated in FIG. 5, over-insertion of contacts is prevented, thus preventing possible damage to the contacts.

The external abutment surfaces 53 preferably confront and abut the respective surfaces 20 of respective circuit boards 16, 17. Surfaces 53 may serve as standoffs, i.e., providing stand-off function for the terminal portions 13*t* (FIG. 6B, for example) of the respective contacts 13. More specifically, a recessed area or space 57 is provided between the bottom wall 58 of the connector housing 12 where the contact terminal portions 13*t* protrude out from respective connectors 11T, 11B. The space 57 provides room for such contact terminal portions 13*t* to be oriented for connection to the solder pads 21 of a circuit board 16, 17, for example, using conventional surface mount techniques and/or other techniques.

The wing portions 50, 51 also include a respective fastening mechanism 60, 61 for fastening the connector 11 to a circuit board or to some other device. In the embodiment illustrated in FIGS. 4A, 4B and 5, one exemplary fastening mechanism 60 is shown as a metal post, pin, rivet, screw, etc., 62 which passes through an opening 63 in a land 64. Land 64 forms part of the connector base and, thus, the base of the wing portion 50. The post 62 may be insert molded in the land 64 during plastic injection molding (or other manufacturing technique) of the connector housing 12. The exposed end 65 of the post 62 may be used in conventional fashion to secure the connector 11T to a circuit board, for example, by soldered connection, threaded connection to a nut, rivet connection, etc. A head 66 on the post 62 prevents it from being pulled through the opening 63. In an alternative embodiment, the fastening mechanism may be a pin-like protrusion that is directly molded of the same material as and as part of the connector housing 12, as is exemplified in the embodiment illustrated in FIGS. 18-22. Other forms of fastening mechanism also may be employed. The fastening mechanism 61 preferably is the same or substantially the same as fastening mechanism 60. Preferably fastening mechanisms 60, 61 provide a means of properly aligning the connector with the circuit board or the like to which it is intended to be fastened. Such alignment function in the preferred embodiment is evident in FIGS. 4A and 4B in that relative to the centerline axis 41 across the connector at least one of the pins 62 is offset. For example, the pin 62 and opening 63 of fastening mechanism 60 are centered on such axis 41, whereas the pin 62 and opening 63 of fastening mechanism 61 at the opposite side of the connector 11 are located off-axis. Therefore, the circuit board to which a connector 11 would be attached preferably is formed with openings that are aligned appropriately to receive pins or other fastening mechanism that are correspondingly arranged in respectively centered and offset fashion, thus assuming proper alignment.

Figure 6A:
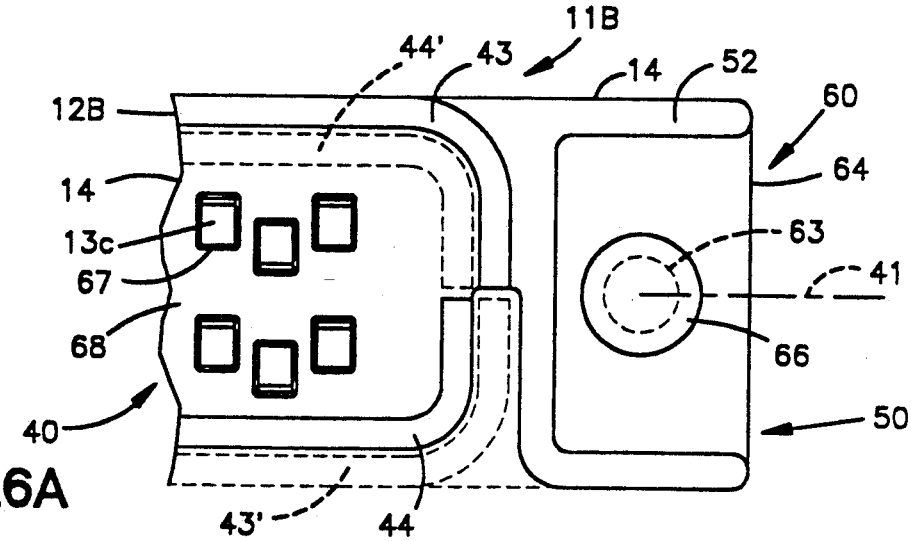
FIG. 6A is a fragmentary top view of an electrical connector in accordance with the present invention looking generally in the direction of the arrows 6A—6A of FIG. 1.

FIG. 6A is an enlarged top plan view of the right-hand portion of the bottom connector 11B. The abutment surface 52, land 64, and opening 63 through such land for the fastening mechanism 60 are shown for the right-hand wing portion 50. Also, the relative location of the shell walls 43, 44 to each other, to the abutment surface 52, and to the shell walls 43', 44' (which are illustrated in phantom) of a mating connector housing are illustrated. Moreover, within the contacting zone 40 the contacting portions 13*c* of the contacts 13 can be seen. Such contacts 13 extend through openings 67 in a bottom wall 68 of the connector housing 12B. Such bottom wall 68 forms part of the connector housing base 14.

Figure 6B:
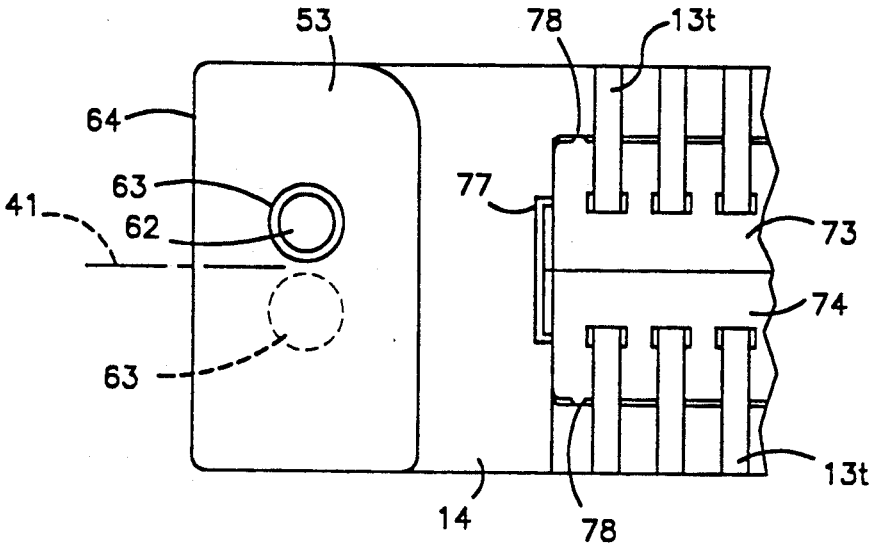
FIG. 6B is a fragmentary bottom view of such electrical connector looking generally in the direction of the arrows 6B—6B of FIG. 1.

The left-hand wing portion 51 of electrical connector 11 is substantially the same as the right-hand wing portion 50, which is illustrated in FIG. 6A, as is evident from FIGS. 4A and 4B, for example. The main difference is that the opening 63 and pin 62 in the left-hand wing portion 51 are offset from the axis 41, as also is evident in FIGS. 4A and 4B. Moreover, the bottom views of the right-hand and left-hand wing portions 50, 51 of electrical connector 11 also are substantially the same other than the offset location of the opening 63 and pin 62. In FIG. 6B is illustrated the bottom view of a left-hand wing portion 51. The illustration of FIG. 6B is looking up at the bottom of the bottom connector 11B in FIG. 1, for example (or FIG. 5); and the opening 63' (shown in dashed outline) represents the opening in the top connector 11T, which is shown in FIGS. 1 and 5, for example.

The contacts 13 are positioned in the connector housing 12, as is illustrated in FIGS. 6A, 6B, 7, 8 and 9, to place the contacting portions 13*c* within the shell 15 (and thus in the contacting zone 40) and to place the terminal portions 13*t* in position for connection with solder pads 21 of a circuit board. In the preferred embodiment the contacts 13 are generally elongate Each has a base portion 70, an extended contact arm 71, and a terminal arm 72. The contact arm 71 extends from the base 70 and supports at the distal or far end (or at some other location) the contacting portion 13*c* of the contact. The terminal arm 72 extends from the contact base 70 and supports the contact terminal portion 13*t*. The contact arms 71 and contacting portions 13*c* of the contacts 13 mounted in the respective connectors are positioned, formed, bent, oriented, etc., so as to undergo an interference fit and connection with a respective contact of another such connector.

Figure 7:
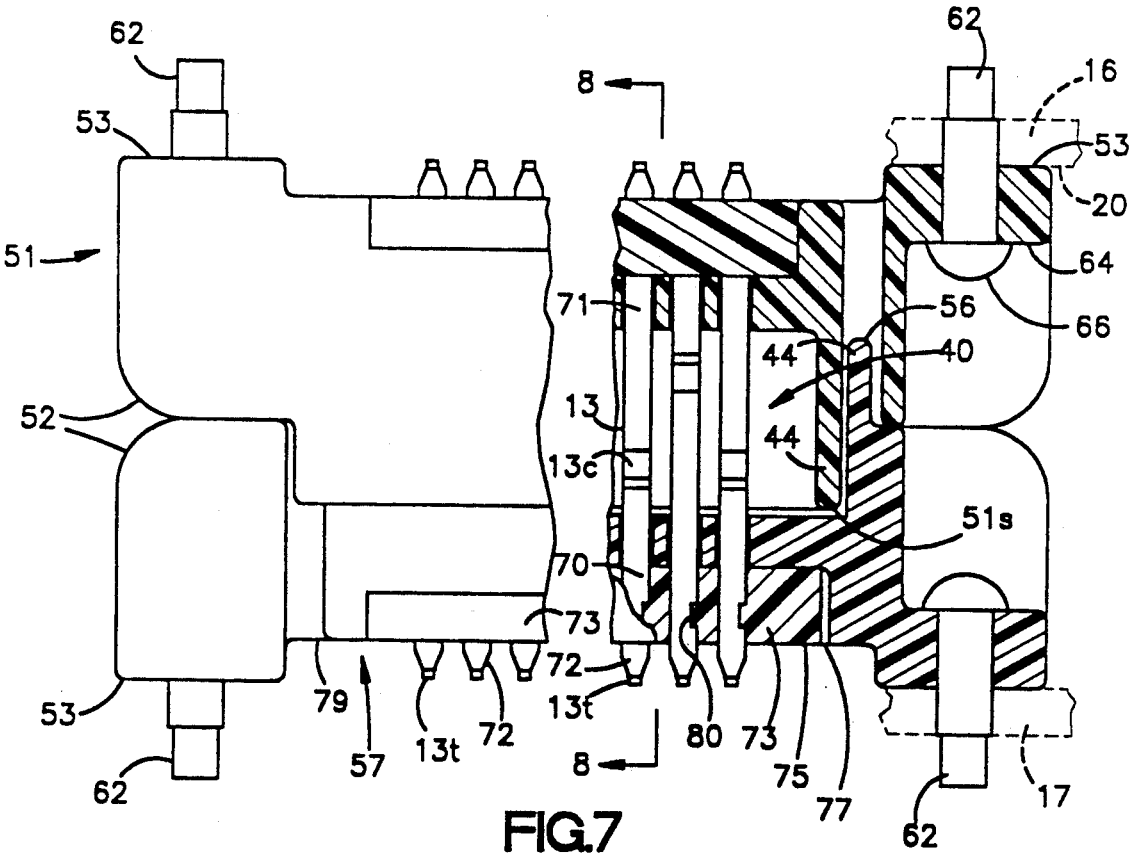
FIG. 7 is a fragmentary front elevation view of the two electrical connectors illustrated in FIG. 1, the right-hand portion of the figure being broken away in section to illustrate several details.

Moreover, preferably the contacts 13 of each of the two connectors 11T, 11B shown in FIG. 7 and in the various other drawings preferably are identical or substantially identical and, therefore, are hermaphroditic. The contacts 13 preferably are mounted in the connector 11 at the contact base. Details of such mounting are described further below. The terminal arm 72 extends from the contact base 70 out into the space 57 at the bottom of the connector housing 12B, for example, and the terminal portion 13*t* is bent so as to extend generally at a right angle relative to the terminal arm 72. Preferably the length of the terminal arm 72 and the location of the terminal portion 13*t* are such that the terminal portion 13*t* may be positioned just slightly above or barely in contact with a solder pad 21 of a circuit board while the stand-off surface 53 provides the desired spacing above the board. Both the solder pad 21 and the contact terminal portion 13*t* may be precoated with solder material; and that solder material can be re-flowed using appropriate infrared, vapor phase or other surface mode mounting technique or other technique to form a secure mechanical and electrical connection between a respective solder pads 21 and contact terminal portions 13*t*. The size, shape and position of the connector housing lands 64 and outer abutment surfaces 53 provide the desired stand-off function to facilitate positioning the contact terminal portions 13*t* relative to the solder pads 21 and for attachment thereof, as described just above the pads, or, if desired, slightly resiliently urged into engagement with those pads. It will be appreciated that the shape, form, size, etc., of the terminal arm 72 and terminal portion 13*t* may be changed according to the nature of the connection between such terminal portion and some other electrical or electrically conductive member. For example, the terminal arm 72 and terminal portion 13*t* may be of the slotted and pointed type used for insulation displacement connection (IDC) with the conductor in an insulated electrical cable; they may be relatively smooth and flat for soldered connection with a conductor of a cable or with a conductive pad at the edge of a circuit board; etc.

Continuing to refer to FIGS. 6B, 7, 8 and 9, a plurality of contacts 13 are mounted in respective header-type connectors 73, 74. As is well known, a header or header connector is a type of electrical connector device that is formed by one or more electrical contacts arranged in a prescribed pattern and supported by an electrically non-conductive support body. One example of an electrical header is a plurality of pin-type contacts arranged in a row and supported by a common electrically non-conductive header support body. The header may include one or a plurality of electrical contacts, and such contacts may be arranged in one or more parallel rows or in another pattern, as may be desired.

In the several illustrated embodiments of the present invention, each of the headers 73, 74 includes a single row of plural contacts 13 secured in respective header bodies 75, 76. The header bodies 75, 76 are positioned and mounted in a hollow recess 77 formed in the connector base 14. The recess 77 is of a size and shape to receive the header bodies 75, 76. The header bodies 75, 76 may be secured in the recess 77 by frictional engagement with the recess walls, e.g., by interference of bumps 78 with walls of the recess 77, by appropriate tapering, and/or by heat staking at part or all of the exposed confronting edges between the header body and bottom surface of the connector base 14. An example of such heat staking is indicated at 79. With the housing 12 secured by fastening mechanisms 60, 61 to a circuit board, the headers 73, 74 will be trapped between the housing and board.

The header bodies 75, 76 are molded directly to the respective contacts intended to be supported thereby using conventional plastic injection molding technique. The contacts 13 have cut outs 80 in the base 70 thereof. During such molding some of the molding material flows into the area of the cut out 80 to lock the contact in the header body tending to resist pulling of the contact loose from the header body in a direction generally parallel to the linear extent of the contact base 70, contact support arm 71 and at least part of the contact terminal arm 72.

The contacts 13 preferably are formed of sheet or strip metal material In fact they may be stamped or cut from a strip of metal. As viewed in FIG. 7, the width of the contact base 70 and contact arm 71 preferably is larger than the thickness of the material from which the contacts are formed, e.g., cut. Such thickness dimension is depicted both in FIGS. 8 and 9 and in the viewed terminal portions 13*t* in FIG. 7. Such relatively larger width dimension helps prevent rotation of the contacts about the linear axis thereof (mentioned above) while retained in a header body. Further, the terminal arms 72 preferably are tapered from the relatively wide base 70 to the relatively narrower terminal portion 13*t*. Such relatively narrow terminal portion 13*t* minimizes the space or so-called real estate required on the circuit board to attach the terminal portion to a solder pad 21.

The headers 73, 74 may have the same or a different number of contacts therein and/or specified arrangements of contacts therein In the event the headers 73, 74 (including the contacts thereof) are different or of an odd number, a keying or polarizing mechanism 81 may be used to assure proper contact orientation relative positioning, alignment and assembly of the respective headers. For example, the header body 75 may include several tab-like protrusions 82 and the header body 76 may include several openings 83 to receive such protrusions 82. With the protrusions and openings 82,.83 strategically located in the header bodies, assured relative positioning of such header bodies and in particular the contacts thereof can be obtained. Alternatively or additionally, such keying may be achieved by a difference in length of the headers. For example, to assure that the headers 73, 74 are properly oriented and/or positioned in the recess 77 of the connector housing base 14, one of the header bodies may be longer than the other, and the recess 77 may be longer on that side or portion thereof intended to receive such relatively longer header.

The preferred embodiment of the invention uses a pair of headers, each having one row of contacts therein. However, it will be appreciated that the invention may employ a single header with one row or a plurality of rows of contacts therein or may employ more than two headers, each having one or more rows of contacts therein The particular number of headers, number of contacts, and arrangement of contacts are matters of choice and will depend, for example, on the number and nature of the connections intended to be made by the electrical connector 11.

As the headers 73, 74 are inserted into the hollow recess 77 in the connector base 14, the contacting portion 13*c* and contact arm 71 of respective contacts 13 are inserted through respective openings 67 in the wall 68 to position the contacting portions in the contacting zone 40 within an area generally circumscribed by the shell 15. The extent that such contacts protrude into the contacting zone is determined, of course, by the length of the contact arm 71 and the size and shape of the respective header body 75, 76, recess 77 and wall 68 of the housing base 14.

The openings 67 preferably are slightly tapered from a wider area confronting the recess 77 to a narrower area facing the contacting zone 40 in order to help guide the contacting arms 71 and contacting portions 13*c* correctly into the contacting area 40 without damaging the contacts The relatively narrow cross-sectional area of the opening 67 facing the contacting zone 40 minimizes the possibility of dirt or other material gaining access to the interior of the opening 67 and/or to the header body therein, on the one hand, and yet provides space for bending of the contact arm 71. Therefore, the effective cantilever length of the contact arm 71 extends from the header body rather than from the top surface 84 of the connector housing wall 68. Such longer cantilever arm may be relied on to increase the compliance characteristics of the contact arm 71 while maintaining the strength characteristics of the connector housing 12 without increasing the height profile thereof.

A number of additional advantages inure to the use of headers 73, 74 for supporting contacts 13 in the connector 11. For example, the plastic injection molding technique to form the connector housing 12 may be relatively uncomplicated because there is no need to mold plural contacts therein; this simplifies, expedites, and reduces in cost the molding process compared to insert molding requirements. Headers can be made relatively easily using conventional plastic injection molding techniques. Also, plural contacts supported in a header can be relatively easily formed or shaped using conventional stamping or forming processes as compared to more complex forming processes that would be needed if the contacts were formed after being insert molded into the connector housing 12 or as compared to the even more complex molding technique required to perform insert molding of contacts that have a complicated shape. Still further, by substituting different headers, such as those having different shape contacting portions 13*c* or terminal portions 13*t* and corresponding arms 71, 72, specialized connectors 11, e.g., for mounting on a circuit board, for attachment to an electrical cable, etc., can be made relatively easily without having to modify housing 12. Still another advantage is that the particular pattern arrangement of contacts in the connector can be easily changed by omitting specified contacts from the header thereby to leave unfilled or blank openings 67 in the connector, as may be desired.

In an alternate embodiment contemplated by the invention, the openings 67 may be replaced by one or more respective slots in which a plurality of contacts 13 may be placed. In such case, headers may be used having different respective contact size and/or spacing arrangements.

Although the preferred embodiment utilizes headers to place contacts in the connector housing 12, it will be appreciated that the contacts 13 may be insert molded or otherwise molded directly in place in the connector housing. Alternatively, such contacts may be individually placed in appropriate openings 70 in the connector housing and supported by interaction with appropriate parts of the connector housing. Various other techniques may be used for placing and/or holding the contacts in the connector housing 12.

Figure 8:
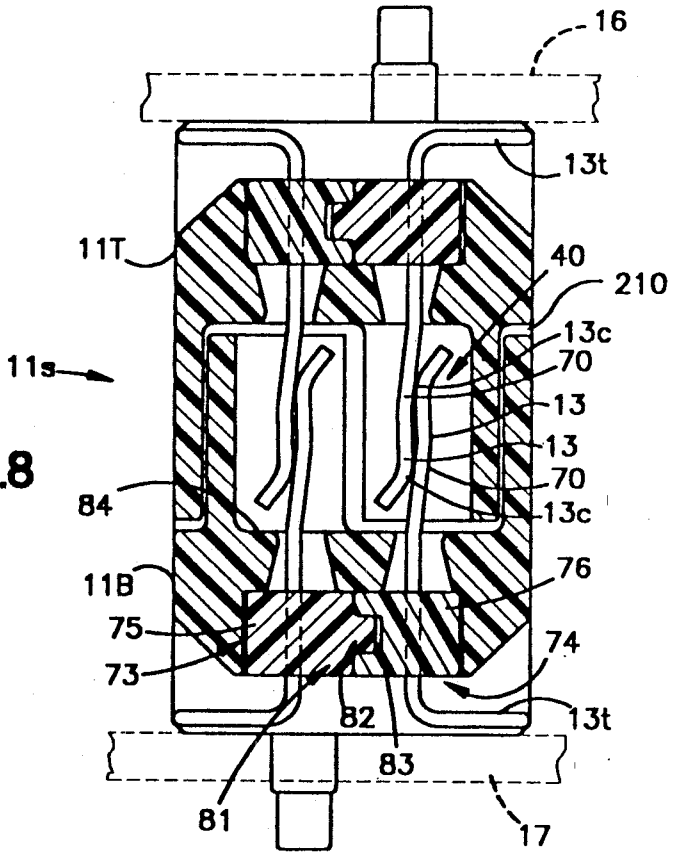
FIG. 8 is a side elevation view, partly broken away in section, of the electrical connectors of FIG. 7 looking generally in the direction of the arrows 8—8 of FIG. 7.

Referring to FIGS. 7 through 14, the preferred configuration of contacts 13, particularly the contacting portions 13*c* and contact arms 71, are illustrated. The contacts 13 are insert molded in header bodies 75, 76, and in each header 73, 74 the contacts are arranged in a straight row. Moreover, to make the contacts hermaphroditic, the contacting portions 13*c* are curved or bowed in convex fashion to engage the contacting portion of a mating contact and to wipe along the contact arm of such mating contact, for example, as illustrated in FIG. 8. Preferably the contact arms 71 are slightly bent toward the direction of such convex curvature or bowing of the contacting portion 13*c* in order to assure confronting engagement of mating contacting portions 13*c* of respective contacts. Such bending also assures that a compliant resilient force will urge the respective contacting portions toward each other and toward the contact arm of the mating contact, e.g., as is seen in FIG. 14B. In FIG. 14B the contacting portions 13c of mating contacts are shown just beginning to engage each other, and in FIGS. 8 and 14C the contacting portions are shown engaged with respective contact arms 71 of mating contacts after full insertion or connection of the respective mating contacts.

Figure 14C:
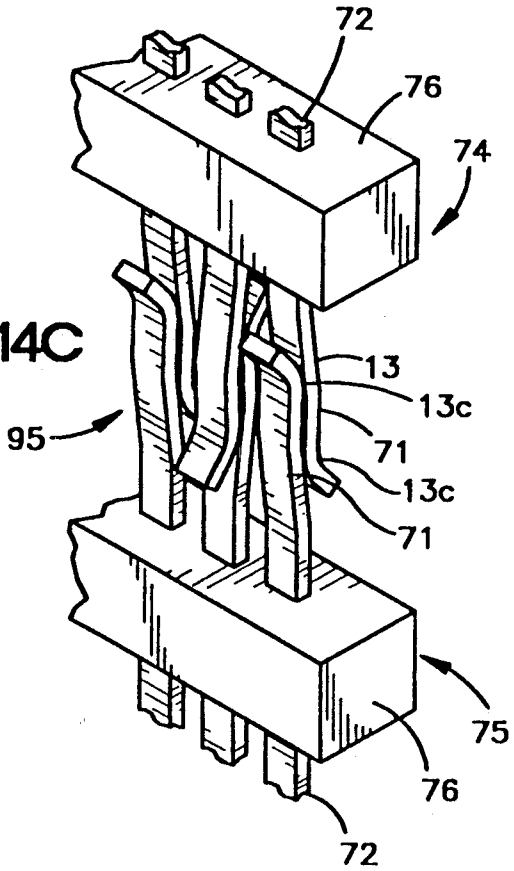
FIG. 14A, 14B, and 14C are fragmentary schematic isometric views of a pair of header connectors, respectively, aligned for interconnection, beginning interconnection, and fully interconnected.
Figure 14B:
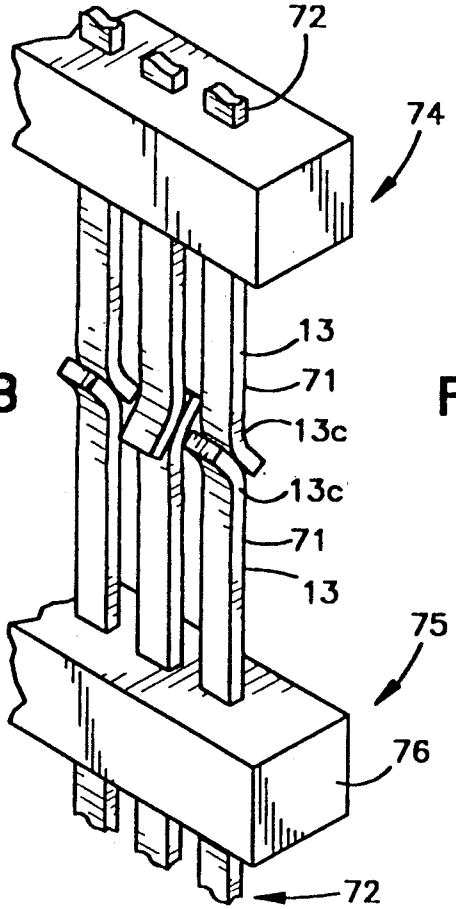
Figure 14A:
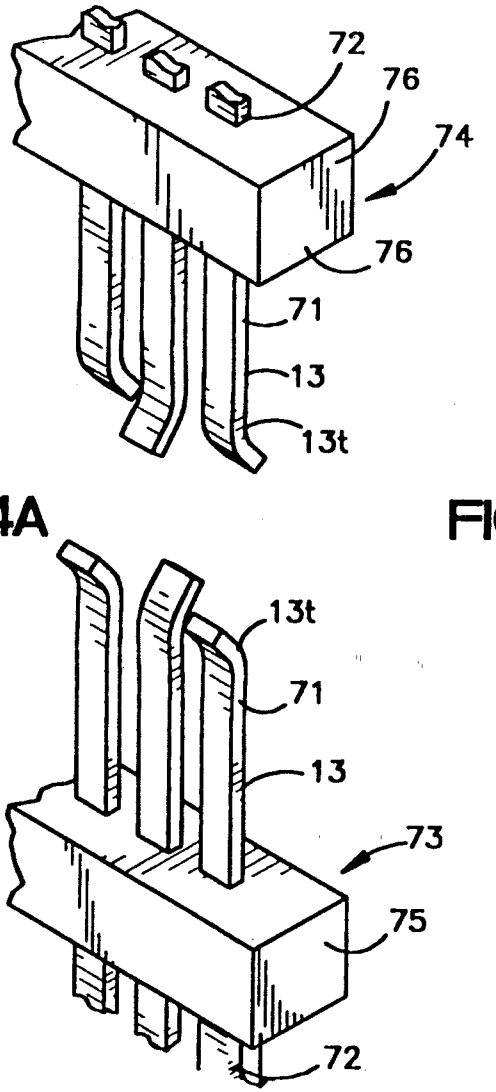
Figure 15:
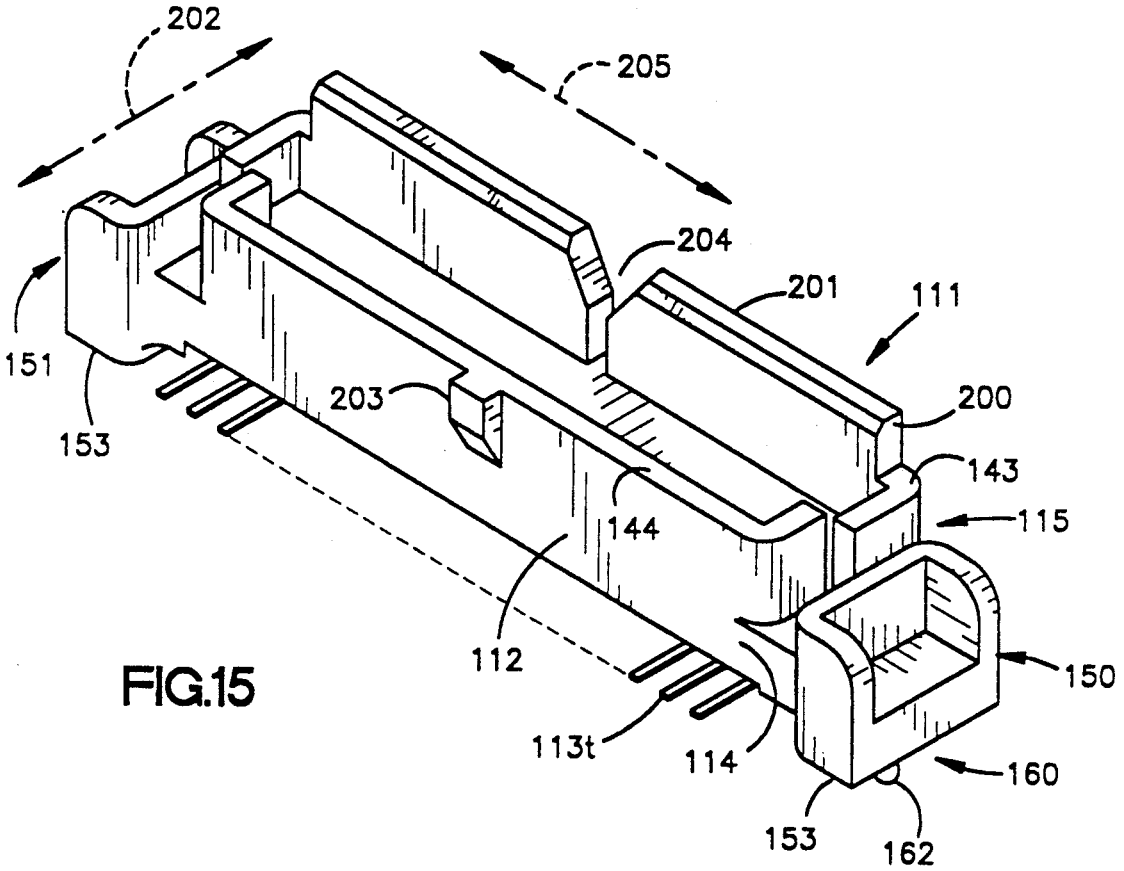
FIG. 15 is an isometric view of an alternate embodiment of hermaphroditic electrical connector in accordance with the present invention, the contacts and openings therefor within the connector shell being omitted for clarity of illustration of the housing.
Figure 16:
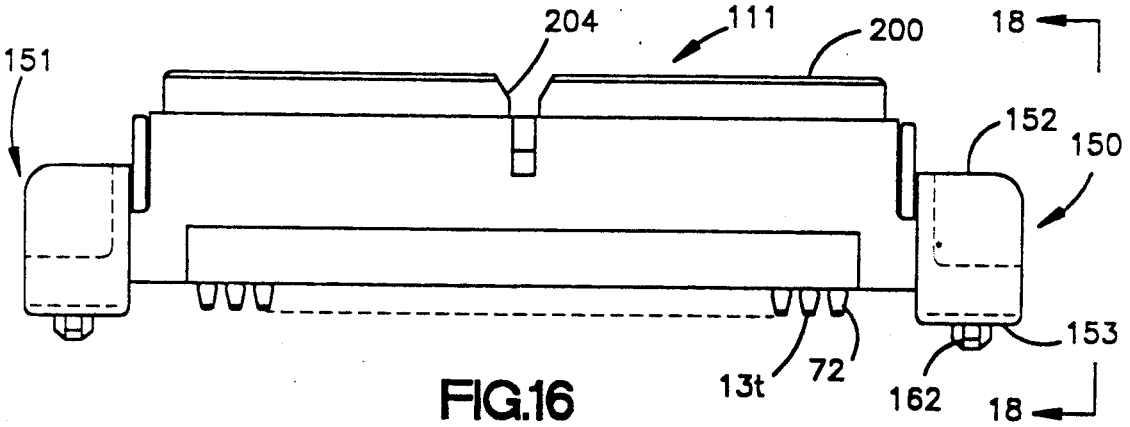
FIG. 16 is a front elevation view of the connector of FIG. 15.
Figure 17:
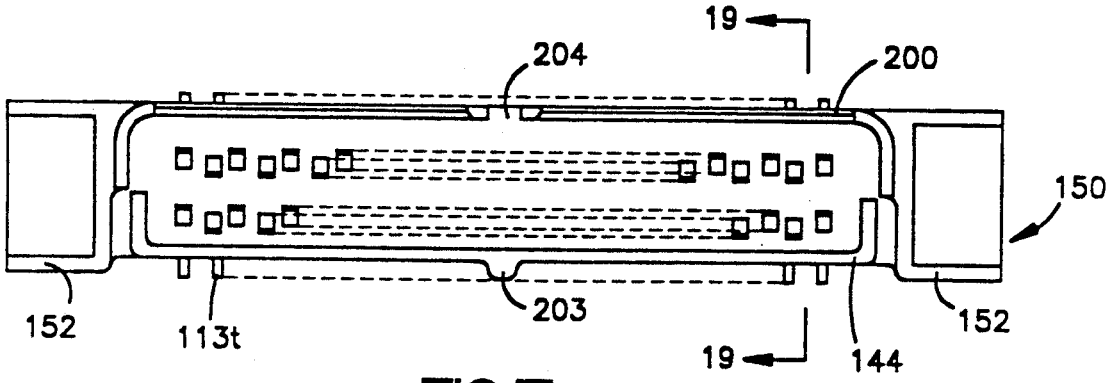
FIG. 17 is a top view of the connector of FIG. 16, this time showing the contacts.
Figure 18:
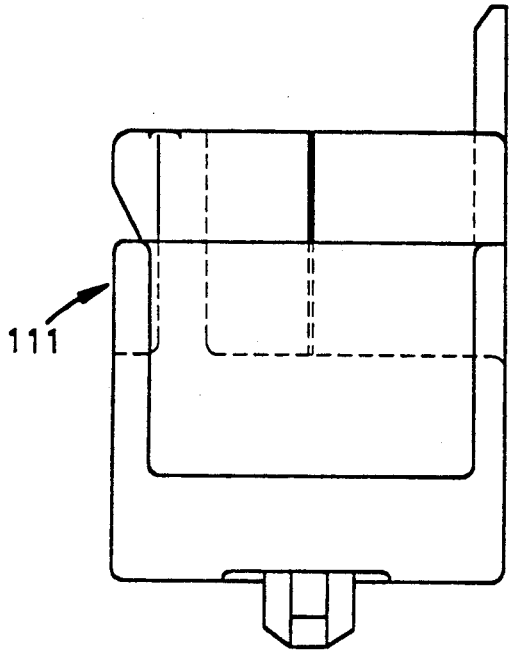
FIG. 18 is an end elevation view of the connector of FIG. 16 looking generally in the direction of the arrows 18—18 of FIG. 16.
Figure 19:
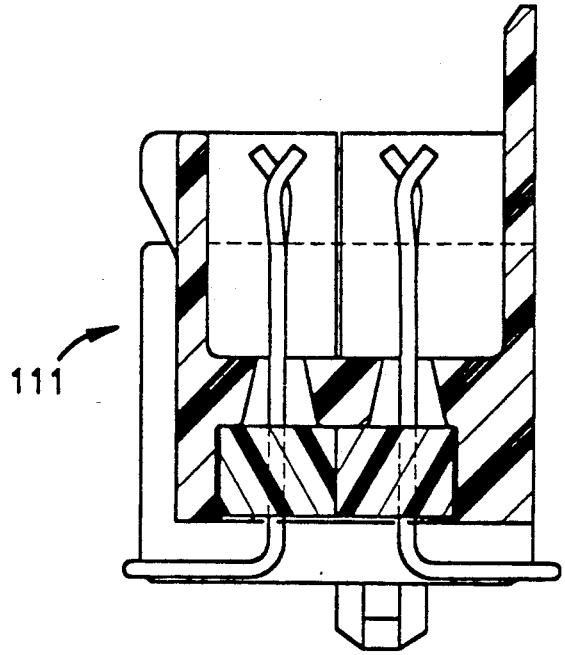
FIG. 19 is a section view of the connector looking generally in the direction of the arrows 19—19 of FIG. 17.
Figure 20:
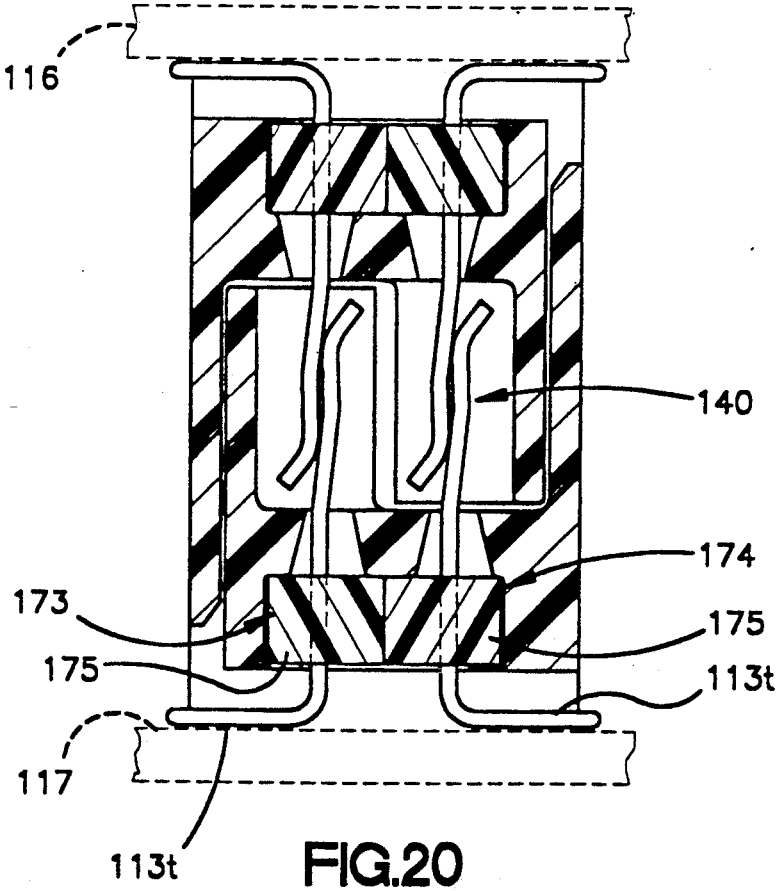
FIG. 20 is a section view of two of the connectors of FIG. 15 placed in nested interconnected relation.

Preferably the directions of bowing or curvature of the contacting portions 13c of respectively adjacent contacts in a particular header alternate in the manner illustrated in FIGS. 14A through 14C. The adjacent contacts in adjacent headers 73, 74 preferably are bowed to face in the same direction. Since the connectors 11T, 11B preferably are identical, when they are placed in mating connection the bow direction of mating contacts is opposite in order to achieve the confronting and wiping engagement of respective contacts in the manner illustrated in FIGS. 7 through 14.

A number of advantages inure to the configuration of contacts used in the invention. For example, due to the direction of bow, the surface area of interconnection between pairs of mating contacts is rather large, i.e., across the width of the contact and preferably achieved by both contacting portions of the respective mating contacts. Additionally, the integrity of electrical connection between mating contacts is good because the contacting portion of each mating contact wipes along both the contacting portion of the respective mating contact and the contact arm 71, thus tending to push away material that would tend to interfere with the electrical connection.

Another important advantage of opposite bow direction for respectively adjacent contacts in a particular header 73, 74 is the balancing of forces in the header. Specifically, the moment or torque applied by one contact in the header, as that contact is deformed during connecting and while connected with a mating contact, is counterbalanced by the moment or torque applied to the header by the relatively adjacent contact. As a result, the sum of such torques along the length of the header is relatively small and preferably zero. An attendant advantage is minimization of the size and strength of the various portions of the connector housing 12 required to hold the headers in place, for forces needed to counteract a tendency of the headers to bend, twist or rotate in the housing are minimized. Further, since the contacts 13 are positioned in the header body so that bending force is applied across the width of the contact and since the width is greater than the contact thickness, the contacts can be very stiff across the width, which additionally assures accurate contact positioning in the header and in the housing 12. Such position accuracy is particularly important when the connectors and contacts are very small, e.g., having contacts spaced center to center by about 0.050 inch.

Figure 9:
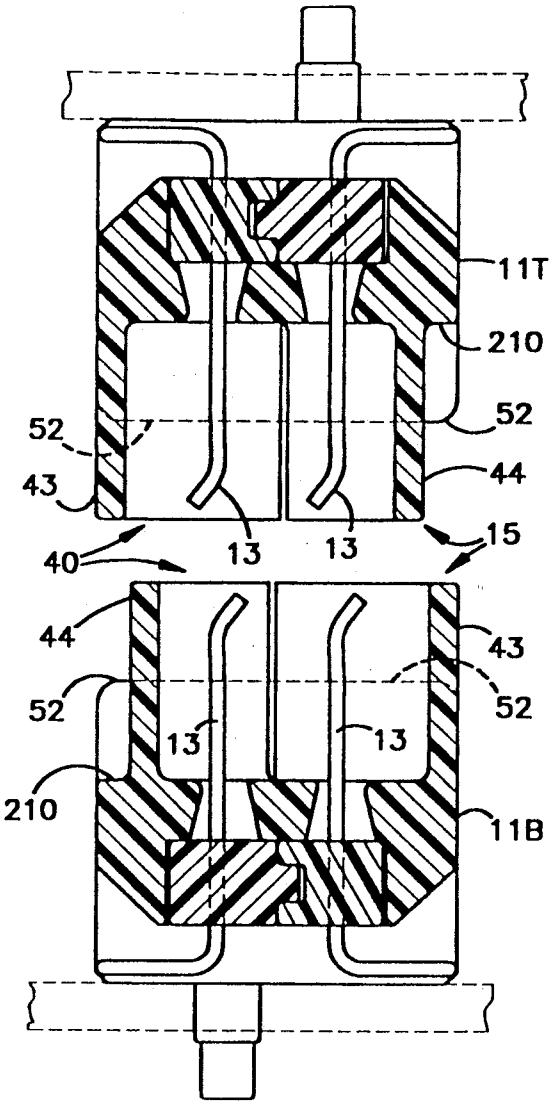
FIG. 9 is side elevation section view of the two connectors similar to the illustration in FIG. 8, but showing the connectors separated from each other and aligned for subsequent interconnection.

In order to accommodate the slightly bent shape of the contact arms 71 and to provide space for inserting the bowed contacting portions 13c in opposite directions for respectively adjacent contacts in the headers 73, 74, to help assure proper positioning of the headers and respective contacts in the connector housing 12, and/or to maximize strength of the connector housing, particularly the connector base 14, while minimizing the amount of material required for the same, the openings 67 preferably are offset in a manner illustrated in FIGS. 6A, 8 and 9, for example Such offset arrangement of openings 67 also helps to minimize the size of such openings to prevent entry of dirt and to maximize the strength of the connector housing. This also helps to prevent insertion of header assemblies in an improper orientation.

In FIGS. 7, 8 and 9, the manner in which two hermaphroditic connectors 11T, 11B can be assembled is illustrated. In FIG. 9 the connectors 11T, 11B, which are mounted on respective circuit boards 16, 17, are aligned relative to each other. As the connectors are moved toward each other, the respective shells 15 slide over one another. More specifically, the shell wall 43 of the top connector 11T slides along the surface, over and outside the shell wall 44 of the lower connector 11B. Similarly, the wall 44 of the upper connector 11T slides along the inner surface of the outer wall 43 of the lower connector 11B. The distal or far ends or edges 55, 56 of the respective walls 43, 44 of the connectors 11T, 11B preferably stop short of engaging respective base surface areas or other surface areas of the respective mating connector, according to the insertion limitation provided by the abutment surfaces 52 at respective wing portions 50, 51 of the connectors The discontinuity or opening 46 between the shell walls 43, 44 of each respective connector enable respective shells 15 of the connectors 11T, 11B to interconnect in the manner described and illustrated.

As the connector housings 12 of connectors 11T, 11B of FIGS. 7, 8 and 9 are interconnected in the manner described above, the contacts 13 of respective connectors 11T, 11B also mate and connect with each other in the manner illustrated in FIGS. 14A, 14B and 14C. Specifically, as the shells 15 of respective connectors are placed into alignment with each other, the contacts 13 are aligned in the manner illustrated in FIG. 14A, for example. As the shells 15 of respective connectors are slid over each other, the contacting portions 13c of respective contacts 13 engage each other in the manner illustrated in FIG. 14B. The contacting portions 13c of mating contacts are bowed or curved respectively in confronting relation, as is illustrated, to slide smoothly over one another. Further sliding of the connector shells over each other causes the contacting portions of respective contacts to slide over the contact arm 71 of the respective mating contact ultimately to achieve the interconnected state depicted in FIG. 14C.

The connectors 11T, 11B then remain in interconnected relation relatively securely holding to each other and also holding the circuit boards 16, 17 in positional relationship. Depending on weight, strength and similar parameters, the circuit boards 16, 17 may be mechanically and electrically interconnected only via the pair of interconnected connectors 11T, 11B. Alternatively, additional means may be employed to provide a mechanical interconnection and/or an electrical interconnection of the circuit boards 16, 17. Further, if desired, a plurality of connectors 11 may be mounted on each of the circuit boards 16, 17 in strategic locations so that the mechanical and electrical connections of the circuit boards can be achieved using such plural pairs 11T, 11B of connectors. Referring to the latter example, a connector 11 may be located at each end, at each corner, or elsewhere on each of the circuit boards 16, 17.

The contacts 13 may be made in the manner illustrated in FIGS. 10 through 13. Such contacts may be stamped from a sheet of material, such as a conventional nickel silver alloy. Preferably such material is spring tempered to provide the desired compliance and strength characteristics for the contacts. An exemplary alloy is sold under the identification C770. Preferably the contacts are gold plated at least in the contacting area 13c, and preferably also in the area of the contact arm 71 intended to be engaged with a contacting portion of a mating contact. Moreover, the terminal portions 13t preferably are coated or plated With a conventional solder material, such as a 60/40 tin lead material, which can be re-flowed during a surface mount process.

The contacts preferably are stamped using a conventional stamping die thereby to form a plurality of elongate contacts 13 that are fastened to a removable carrier strip 90 at a frangible connection 91. The carrier strip 90 preferably has a plurality of stamped openings 92 therein to facilitate precision guiding of the contacts and carrier strip in the stamping die and to provide a means for locating the contacts for the header molding process. The contacting portion 13c, contact arm 71, base 70, terminal arm 72, and terminal portion 13t are seen particularly in FIGS. 10 and 11. The contacts preferably are cut from the initial sheet of strip material such that the terminal portion 13t and terminal arm 72 are of relatively narrower width than the other portions of the contact, and the cutout 80 is formed in the base 70. The wider contacting portion 13c and contact arm 71 maximizes surface area of connection between mating contacts, and the narrower terminal portion 13t minimizes board space needed for connection to terminal pads 21.

Figure 10:
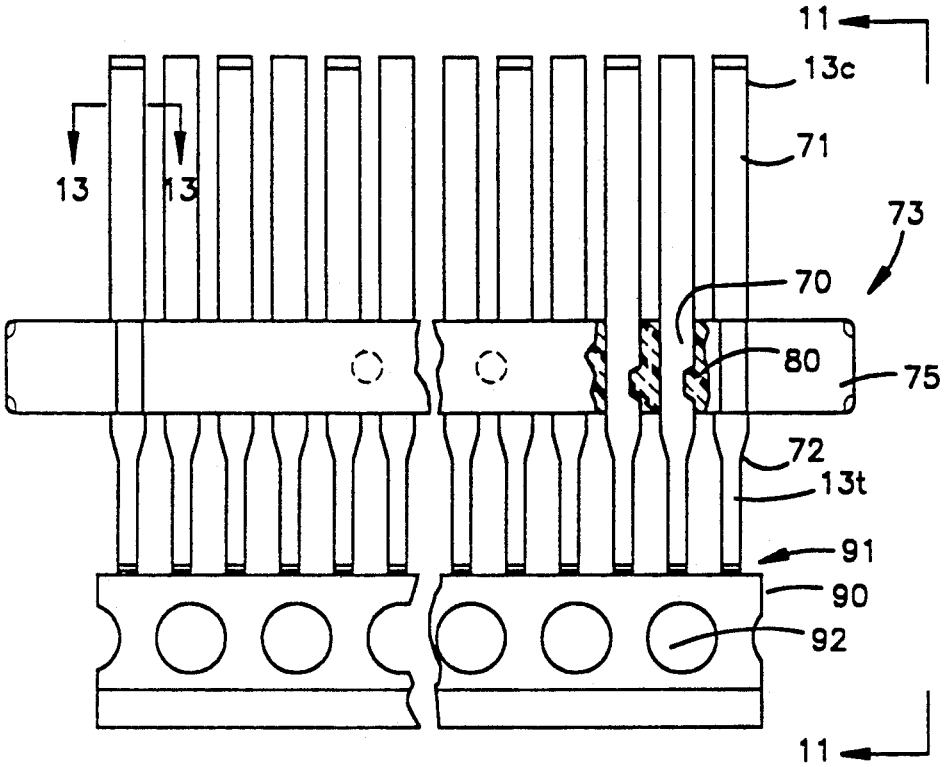
FIG. 10 is a plan view of a header connector according to and used in embodiments of the invention including plural contacts held by a header support body.
Figure 12:
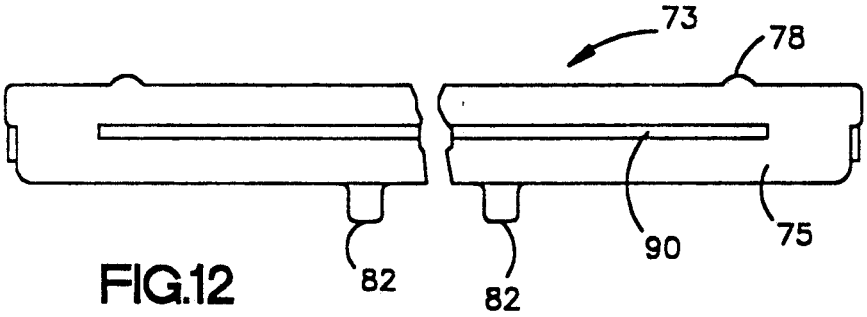
FIG. 12 is a front elevation view of the header connector looking generally in the direction of arrows 12—12 of FIG. 10.
Figure 13:
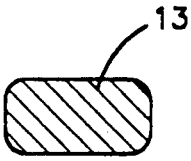
FIG. 13 is a section view of the contacting end of one of the contacts of the header connector looking generally in the direction of arrows 13—13 of FIG. 10.
Figure 11:
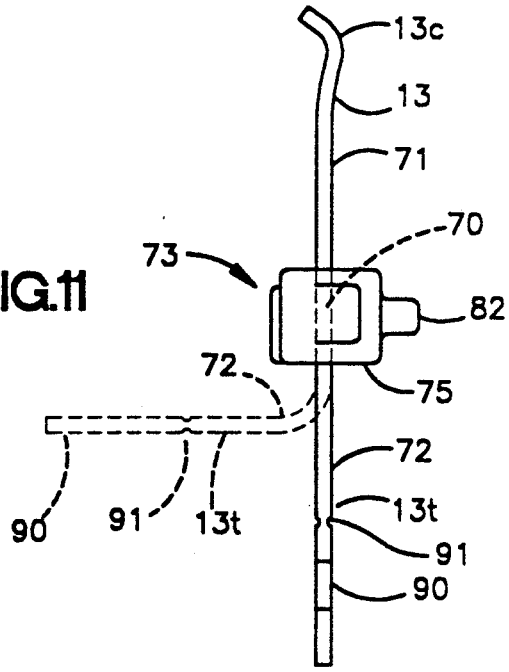
FIG. 11 is a side elevation view of the header connector looking generally in the direction of arrows 11—11 of FIG. 10.

A header body, such as header body 75, is directly molded to the base of a plurality of contacts in the manner illustrated in FIGS. 10-12. The header body may be, for example, electrically non-conductive glass-filled liquid crystal polymer material, such as that sold under the trademark Vectra. The header body 75 includes a pair of protruding tabs 82. Such tabs fit into recesses 83 (FIG. 8) in a mating header for proper alignment and selection of a pair of headers intended to be used in a connector, as was described above. In the event the headers 73, 74 (FIG. 8) would be identical, for example, if an even number of contacts were included on each and/or the contacts were identically positioned on each, then the alignment feature of tabs 82 and recess 83 could be eliminated. The header body 75 also includes bumps or features 78, which engage frictionally with the walls of the recess 77 in the base 14 of the connector housing 12.

Preferably, the various bends and curves in the contacts 13 are formed after the header body 75 has been molded to the contacts, although, if desired, the various forming and shaping done to the contacts could be performed prior to such molding. The shaping and forming of the contacts preferably is initiated by coining all four corner edges of each contact in the area that will include the contacting portion 13c and the contact support arm 71. Such coining is depicted in the cross-section view of FIG. 13. All four corner edges are coined to be relatively smooth, avoiding sharp edges, so that regardless of whether the contacting area 13c is bowed in one direction or the other, mating contacts will encounter only smooth surfaces and scraping of gold or other damage is avoided.

After the contacts have been coined, the contacting portions 13c are bowed in one direction or the other, and any bends desired in the respective contact arms 71 can be formed using conventional bending, stamping, and like equipment. At the same time or separately, the terminal portions 13t and terminal arms 72 can be bent, e.g., in the manner illustrated in dashed outline in FIG. 11. By retaining the carrier strip 90 still attached to the terminal portions 13t during such forming of the terminal portions and terminal arms, added leverage, accuracy and uniformity are obtained. After the terminal portions 13t have been bent as desired, the carrier strip 90 can be broken away at the frangible connection 91, and the header then can be installed in a connector 11 in the manner described above.

Referring to FIGS. 14A, 14B and 14C, the invention also includes a header connector or electrical connector of the header type and a header interconnect system generally designated 95. Such a header interconnect system includes a header connector 73, for example, which has a plurality of electrical contacts 13 that are mounted in a support body 75 and are arranged so that one or more of the contacts is intended to deflect in one direction during connection with an external member (such as another electrical contact or even an electrically non-conductive member) and one or more of the contacts is intended to deflect in the relatively opposite direction when connecting to and/or connecting with another member. Such other member to which the contacts 13 of the header connector 73 may be connected may be straight pin-type contacts, elongate sheet-like contacts, the edge of a circuit board or flexible circuit device, etc. The oppositely directed bowed contacting portions 13c preferably help guide such external member to engagement with the respective contacts; and such respective contacts preferably connect electrically with respective inserted contacts or solder pads or electrically conductive portions formed on a further member, such as a circuit board, flexible circuit device, integrated circuit-type device, etc. Preferably, the bow direction of respective contacting portions 13c of relatively adjacent contacts face in opposite directions; however, other configurations may be employed such that two adjacent contacts face in one direction and the next two in another.

The hermaphroditic connector and/or the header connector of the invention in the various embodiments disclosed herein and equivalents thereof may be used to connect with an electrical connector that has a plurality of pin-type contacts, as was mentioned above. An example of such an electrical connector is known as a header. A header usually has one or two, or sometimes even more, rows of plural pin-type electrical contacts, in one example such contacts are square posts that have a diameter or side width of about 0.025 inch. To facilitate connecting with such posts or similar pin-type contacts, the contacts 13 of the hermaphroditic connector 11 or header connector 73, according to the present invention, may be offset to accommodate the posts. For example, using 0.025 inch posts, alternate contacts 13 in one row may be offset from the centerline of the row of contacts 13 by about 0.0125 inch; and the other alternate contacts may be offset by about 0.0125 inch toward the opposite side of such centerline. The convex portion of the contacting portions should be facing toward the centerline and should reach to near the centerline an adequate amount to assure wiping against a post inserted to engagement therewith and yet not interfere with the insertion of such post to such an extent that would block such insertion. Using alternating offsets as is described, the connector 11, 73 may connect with a header that has a single row of contacts or a header that has plural rows of contacts. In the latter case the contacts in the second and further row(s) of contacts 13 of the connector 11, 73 would also be arranged in the alternate offset relationship.

Preferably, the member to which the header connector 73 would be connected is a similar header connector 74, as is illustrated in FIGS. 14A, 14B and 14C. With the contacts of one header connector, say header connector 73, aligned with respective contacts of another such header connector, say header connector 74, the two header connectors may be moved toward each other and to engagement of respective pairs of contacts in the manner illustrated in FIG. 14B and to the final connected relationship illustrated in FIG. 14C. The header connectors 73, 74 illustrated in FIG. 14C have the ability to remain aligned and interconnected in the manner so illustrated without further support or aligning mechanism in view of the opposing and balancing of forces by respective contacts, as was heretofore described. Initial alignment of the contacts in the manner illustrated in FIGS. 14A and 14B may be accomplished manually, by a further connector housing or by some other means. In the preferred embodiment of the present invention such alignment is by housings 12 of respective connectors 11.

As in the case of the hermaphroditic electrical connector 11 described in detail above, the header connectors 73, 74 of FIGS. 14A, 14B and 14C may be used in a board to board interconnect system, a cable to cable interconnect system, a cable to board interconnect system, and so on. The termination arms 72 may have appropriate termination portions (not shown in FIGS. 14A, 14B or 14C), configured for connecting appropriately to a circuit board, to conductors of a cable, etc. Appropriate strain relief may be secured, as by mechanical connection, direct molding, and so on, as also was described above, for example, with respect to the systems 10' and 10'' of FIGS. 2 and 3.

A preferred embodiment and best mode of carrying out the present invention is illustrated in FIGS. 15 through 22. In such drawing figures parts that correspond to those described above with reference to FIGS. 1 through 14 are identified by corresponding reference numerals plus the value 100. Accordingly, the hermaphroditic electrical connector 111 illustrated in FIGS. 15 through 22 corresponds to the hermaphroditic electrical connector 11 described above with reference to FIGS. 1 through 14. The description with respect to the various parts of the electrical connector 11 generally is applicable to the electrical connector 111 of FIGS. 15 through 22; particular differences are emphasized below.

The outer wall 143 of the shell 115 includes an extension wall 200. The extension wall 200 is slightly tapered at the leading edge 201. Such extension wall facilitates proper alignment of two connectors 111 with respect to each other, primarily in the length direction of the connector represented by the arrow 202, prior to engagement of contact with each other. Moreover, a tab-like protrusion 203 on the shell wall 144 is aligned with and intended to cooperate with a tapered opening 204 in the extension wall 201 of a mating connector 111 to assist in providing lateral alignment of the connectors along the width thereof represented by arrow 205. Such alignment features help assure physical or mechanical alignment of two connectors 111 with each other prior to the actual overlapping nested fit of the respective walls 143, 144 of one such connector with those of the mating connector and prior to engagement and full connection of the respective contacts of such connectors. To provide a space for receiving the extension wall 200 of a mating connector, the shell wall 144 and the base 114 of the connector housing 112 are modified to eliminate the step area seen at 210 in FIGS. 8, 9 and 10, for example.

The right-hand and left-hand wing portions 150, 151 also are modified in particular in that the fastening mechanism 160 is in the form of a molded protrusion 162 that has a resiliency characteristic enabling it to be deformed to fit into a hole in the circuit board and to expand in such wall to hold the connector 111 in place on the circuit board. If desired, the wing portions 50, 51 or 150, 151 may be omitted or substantially modified; in such case the soldered attachment of contacts 13 to pads 21 or some other means may be relied on to hold the connector to a circuit board.

As is seen in FIG. 22, the recess 177 in the bottom of the connector housing base 114 is modified from the recess 77 illustrated in FIG. 6B, for example. Specifically, such recess 177 has portions 211, 212, which receive therein respective headers 173, 174. The area 212 has an extension 213 so that it is permissible that the header 174 intended to be placed therein may have a body 176 which is longer than the body 175 of the header 173. Therefore, a distinction between the headers 173, 174 can be made according to the lengths of the headers and the space provided in the recess 177 to receive such headers. Proper positioning of the headers in the connector housing 112 then is permissible even without the need for the above-mention protrusion and recess 82, 83 (see FIGS. 8 and 9).

In the several embodiments hereof, it will be appreciated that the proper positioning of the headers in the contact housing may be determined by one or more of the various features that include the combination of protrusions and recesses 82, 83, the header length and recess extension 213 (FIG. 22), the offset arrangement of openings 67 in the bottom 68 of the connector housing, etc. Other means also may be provided to facilitate properly positioning the contacts in the connector housing in order to achieve desired facing directions of the respective bow curvature of the contacting portions **13*c*** of respective contacts in the manner illustrated and described herein, and particularly to achieve the desired hermaphroditic characteristic of the connector.

In an exemplary connector 111, the contacts in headers 173, 174 are on 0.050 inch centers and between headers are on about 0.100 inch centers. The housing 112 is just under two inches from wing 150 to wing 151 (wide) and about one-third inch long. Height from the abutment surface 153 to the top of wall 144 is less than 0.4 inch and to the top of the extension wall is about 0.46 inch.

Turning briefly to FIG. 23, a bifurcated contact 313 useful in the several embodiments of the invention is illustrated. The bifurcated contact 313 may be positioned in the connector housing of FIGS. 6A, 6B, 7, 8 and 9, for example, to place the contacting portions **313*c* within the shell 15 (and thus in the contacting zone 40) and to place the terminal portions 313*t* in position for connection with solder pads 21 of a circuit board, in plated through holes of a circuit, etc. The contact 313 is generally elongate. Each has a base portion 370, a pair of extended contact arms 371*a*, 371*b*, and a terminal arm 372**.

The contact arms **371*a*, 371*b* extend from the base 370 and support at the distal or far ends (or at some other location) the contacting portions 313*c* of the contact. The contact portions at the ends of the respective contact arms 371***a*, 371*b* face, respectively, in opposite directions. The terminal arm 372 extends from the contact base 370 and supports the contact terminal portion 313*t*. The contact arms 371*a*, 371*b* and contacting portions 313*c* of plural contacts 313 mounted in respective connectors are positioned, formed, bent, oriented, etc., so as to undergo an interference fit and connection with a respective contact of another such connector generally in the manner described above.

Since the contact 313 has bifurcated contact arms 371*a*, 371*b* and contacting portions 313*c* which face in opposite directions, there will be a balancing of the forces created in a single contact when the contact 313 is connected with another contact 313 as the respective pairs of contacting portions of each engage and resiliently bend. Although some moment or torque will occur in such contacts, such moment or torque will in a sense be balanced within the contact itself and will tend to be quite localized in the header body, connector housing or other device holding the contact. This further minimizes the amount of moment or torque that will be applied to the header body. Another advantage of the bifurcated contact 313 is the quadruple wiping connections made between the four contacting portions 313*c* and respective contact arms 371*a*, 371*b* of a pair of contacts when connected. e.g., generally in the manner illustrated and described above with respect to 14A–14C.

Referring, now to FIG. 24, a trifurcated contact 413 useful in the several embodiments of the invention is illustrated. The trifurcated contact 413 may be positioned in the connector housing of FIGS. 6A, 6B, 7, 8 and 9, for example, to place the contacting portions 413*c* within the shell 15 (and thus in the contacting zone 40) and to place the terminal portions 413*t* in position for connection with solder pads 21 of a circuit board, in plated through holes of a circuit, etc. The trifurcated contact 413 is similar to the bifurcated contact 313 described above with reference to FIG. 23, except that there are three extended contact arms 471*a*, 471*b*, 471*c* supported by the base 470 and the contacting portions 413*c* of the outside contact arms 471*a*, 471*c* face in one direction while the contacting portion 413*c* of the center or middle contact arm 471*b* faces in the opposite direction. A terminal arm 472, as the terminal arm 372 in the contact 313, extends from the base 470 to support the terminal portion 413*t* in connection with a terminal pad, plated through hole, etc.

The contact arms 371*a*, 371*b* and contacting portions 313*c* of plural contacts 313 mounted in respective connectors are positioned, formed, bent, oriented, etc., so as to undergo an interference fit and connection with a respective contact of another such connector generally in the manner described above. Preferably the center contact arm 471*b* is wider than each of the contact arms 471*a*, 471*c* so as to be more stiff so that during connection with another contact 413 the amount of force required to bend the center contact arm is closer to the amount of force required to bend both outer contact arms than would be the case of the width of the center contact arm were the same as that of the outer contact arms. This feature helps to balance forces that occur in the trifurcated contact 413 when connected with another contact.

Since the contact 413 has trifurcated contact arms 471*a*, 471*b*, 471*c* and respective contacting portions 413*c* which face in opposed directions, there will be a balancing of the forces created in a single contact when the contact 413 is connected with another contact 413 as the three respective pairs of contacting portions of the contacts engage and resiliently bend. Preferably the moment or torque that is transmitted to the base 470 by the two outer contact arms 471*a*, 471*c* will be substantially fully balanced by the moment or torque that is transmitted to the base 470 by the center contact arm 471*b*. Therefore, substantially all moments or torques created in the contact 413 due to bending during connection with another contact will be balanced within the contact itself and will not be transmitted to the header body, connector housing or other device holding the contact. This further minimizes the amount of moment or torque that will be applied to the header body. Another advantage of the trifurcated contact 413 is the sextuple wiping connections made between the six contacting portions 413*c* and respective contact arms 471*a*, 471*b*, 471*c* of a pair of contacts when connected, e.g., generally in the manner illustrated and described above with respect to 14A–14C.

The bifurcated contact 313 and the trifurcated contact 413 can be used in the various embodiments disclosed herein.

As is illustrated in FIG. 25, trifurcated contacts 413 can be used in a free-standing or self-standing, unhoused mode to provide electrical connecting and mechanical connecting functions of an electrical connector for an electrical device, such as a circuit board 480 or for some other device. In the illustrated example, the circuit board 480 has various circuitry, e.g., including printed circuitry, electrical components (such as integrated circuits, resistors, etc.) and/or other devices thereon (not shown to facilitate the illustrations). Four trifurcated contacts 413 are, respectively, strategically positioned at corners of the circuit board 480. Fewer or more contacts 413 may be used and they may be placed at selected strategic positions on the board or other device 480. Each trifurcated contact 413 is connected to circuitry on the board 480 in a plated through hole (or some other manner, not shown).

The contacts 413 are able to make electrical connections with other contacts 413, for example, which may be mounted on another circuit board, used in another electrical connector, and so on, without transmitting any moment or torque (or at least with minimum transmission of moment or torque) to the board 480. Therefore, forces due to such bending of contact arms will not or will only minimally affect the connections of the terminal portions 413*t* of the contacts 413 to the board 480. Accordingly, integrity of such connections to the board will be maintained, as respective contacts 413 are connected and disconnected, even if the contacts 413 are not otherwise supported in a connector housing or other device.

The various features of the connector described herein enable secure mechanical and electrical connections to be made using such small size connectors.

STATEMENT OF INDUSTRIAL APPLICATION

With the foregoing in mind, it will be appreciated that the present invention provides means for interconnecting electrical devices, such as circuit boards or other devices, of various types.

The embodiments of the invention in which an exclusive property or privilege is claimed are defined as follows:

1. An electrical interconnection system, comprising two substantially identical electrical connectors, each including electrical contact means for making an electrical connection, and housing means for supporting said electrical contact means, said housing means having guiding means for guiding the housing means into aligned coupled relation with the housing means of the other electrical connector to place the respective electrical contact means of said respective electrical connectors in electrical connecting relation, said electrical contact means comprising plural electrical contacts arranged in a row, each contact including a base and a contacting portion, said contacting portion including a cantilever arm protruding from said base and a curved contacting surface area at the distal end of said cantilever arm for contacting with a contact of similar configuration, and the contacting surface area of a plurality of said electrical contacts facing in respectively opposite directions such that said electrical contacts impart on said housing means about an axis parallel to said row of electrical contacts a net moment substantially equal to zero when in said electrical connecting relation.

2. The interconnection system of claim 1, wherein said curved contacting surface area of respectively adjacent electrical contacts face in respectively opposite directions.

3. The interconnection system of claim 1, wherein said curved contacting surface area of respectively adjacent electrical contacts face in respectively opposite directions.

4. An hermaphroditic electrical connector, comprising plural electrical contacts for making electrical connection, and support means for supporting said electrical contacts to connected engagement with identical respective electrical contacts of another substantially identical electrical connector, said housing means having means for guiding the housing means into aligned coupling relation with the housing means of the other electrical connector, said means for guiding comprising a wall, said wall having opening means therein for receiving a respective wall section of said another substantially identical electrical connector to permit nested overlying connected placement of said wall and said respective wall section when the electrical connector is connected to said another electrical connector, said support means having a longitudinal axis, and said electrical contacts imparting about an axis parallel to said longitudinal axis of said support means a net moment substantially equal to zero when in said connected relation.

5. An hermaphroditic electrical connector, comprising plural electrical contacts for making electrical connection, support means for supporting said electrical contacts, means for holding the electrical connector in connected engagement with another substantially identical electrical connector with respective electrical contacts in connected engagement with corresponding identical electrical contacts of said another electrical connector, said means for holding comprising a wall, said wall having opening means therein for receiving a respective wall section of said electrical connector to permit nested overlying connected placement of said wall and said respective wall section when the electrical connector is connected to said another electrical connector, said support means having a longitudinal axis, and said electrical contacts imparting a net moment substantially equal to zero on said support means about an axis parallel to said longitudinal axis when in said connected relation.

6. A housing for an electrical connector, comprising support means for supporting at least one electrical contact, said electrical contact having a cantilever arm which extends from said support means, and a shell at least partly coextensive with and at least partly surrounding said electrical contact, said shell including a wall which extends relative to said support means at least as far as said cantilever arm, said shell including guiding means for guiding said electrical connector to connected engagement with another electrical connector having a substantially identical guiding means, said guiding means including opening means for receiving at least part of the guiding means of said another electrical connector to permit a generally nested connection of said electrical connectors, said shell having a longitudinal axis, and said support means imparting a net moment substantially equal to zero on said shell about an axis parallel to said longitudinal axis when said electrical connectors are in electrical connected relation.

7. An electrical connector, comprising a housing including a base, a shell peripherally about at least part of the base, and an opening in said base, and a header unit including plural electrical contacts arranged in a row in a support, said electrical contacts each including a cantilever arm protruding from a base and a curved contacting surface area at the distal end of said cantilever arm for contacting with a contact of similar configuration, said curved contacting surface area of respectively adjacent electrical contacts facing in respectively opposite directions, and said header unit being positioned in said opening to position at least part of said plural contacts within said shell.

8. An electrical connector, comprising plural identical electrical contacts arranged in a row, each contact including a base and a contacting portion, and support means for supporting said electrical contacts at said base, said contacting portion including a cantilever arm protruding from said base and a curved contacting surface area at the distal end of said cantilever arm for contacting with a contact of similar configuration, and said curved contacting surface area of respectively adjacent electrical contacts in said row facing in respectively opposite directions.

9. The connector of claim 8, wherein said contacts comprise bifurcated contacts having a pair of cantilever arms extending generally in parallel and contacting portions on each cantilever arm.

10. The connector of claim 9, wherein the contacting portions of the pair of cantilever arms respectively face in opposite directions.

11. The connector of claim 8, wherein said contacts comprise trifurcated contacts having three cantilever arms extending generally in parallel and contacting portions on each cantilever arm.

12. The connector of claim 11, wherein the contacting portions of the pair of outer cantilever arms face in one direction and the contacting portion of the center cantilever arm faces in the relatively opposite direction.

13. The connector of claim 12, wherein the force created by bending the center cantilever arm is about the same as the force created by bending of both the outer cantilever arms.

14. An electrical connector, comprising plural identical electrical contacts arranged in a row, each contact including a base, a terminal portion, and a contacting portion, and support means for supporting said electrical contacts at said base, said contacting portion including a contacting surface area for contacting with an identical contact of another electrical connector, said contacting surface area of respectively adjacent electrical contacts in said row facing in respectively opposite directions, and said terminal portion including a surface area means extending angularly relative to said base for electrically connecting with a solder pad of a printed circuit board or the like.

15. The connector of claim 14, said terminal portion including a resilient arm, and said surface area means comprising a surface of said resilient arm, and further comprising mounting means for holding said support means to such printed circuit board to apply a force counteracting the resiliency of said resilient arm thereby to urge said surface area means thereof into engagement with said solder pad.

16. The connector of claim 15, wherein said solder pad is a solder pad of a printed circuit board, and wherein said mounting means holds said surface area means in engagement with said solder pad for attachment thereto compatibly with surface mount processing.

17. An interconnection system comprising two substantially identical electrical connectors, each electrical connector including gender-neutral electrical contact means for making an electrical connection, and housing means for supporting said electrical contact means, said housing means having guiding means for guiding the housing means into aligned coupled relation with the housing means of the other electrical connector to place the respective electrical contact means of said respective electrical connectors in electrical connecting relation, said electrical contact means comprising trifurcated contacts having three cantilever arms extending generally in parallel and contacting portions on each cantilever arm, and said center contact being more stiff than the outer two contacts.

18. The system of claim 17, said guiding means including a shell generally coextensive with and circumscribing at least a portion of said electrical contact means.

19. The system of claim 18, said shell including guiding means for guiding such electrical connector to connected engagement with another electrical connector having a substantially identical guiding means, and said guiding means including opening means for receiving at least part of the guiding means of such another electrical connector to permit a generally nested connection of such electrical connectors.

20. A board to board interconnection system comprising a plurality of circuit boards, and a substantially identical electrical connector mounted on each of said circuit boards, each electrical connector including gender-neutral electrical contact means for making an electrical connection, and housing means for supporting said electrical contact means, said housing means having guiding means for guiding the housing means into aligned coupled relation with the housing means of the other electrical connector to place the respective electrical contact means of said respective electrical connectors in electrical connecting relation, said guiding means including a shell generally coextensive with and circumscribing at least a portion of said electrical contact means, said electrical contact means comprising plural contacts arranged in a row, each contact including a base and a contacting portion, said housing means including support means for supporting said electrical contacts at said base, said contacting portion including a cantilever arm protruding from said base and a curved contacting surface area at the distal end of said cantilever arm for contacting with a contact of similar configuration, and said curved contacting surface area of respectively adjacent electrical contacts facing in respectively opposite directions.

21. An electrical apparatus, comprising an electrical device containing circuitry, plural electrical contact means directly mounted to such electrical device along a longitudinal axis thereof for mechanically connecting and electrically connecting said electrical device with another member, each electrical contact means including a base and a contacting portion, said contacting portion including a resilient cantilever arm protruding from said base and a curved contacting surface area at the distal end of said cantilever arm for contacting with an external member inserted to resilient engagement therewith, said electrical contact means imparting a net moment substantially equal to zero on said electrical device about an axis parallel to said longitudinal axis when in said connected relation, and wherein said contact means comprise bifurcated contacts having a pair of cantilever arms extending generally in parallel and contacting portions on each cantilever arm.

22. The apparatus of claim 21, wherein the contacting portions of the pair of cantilever arms respectively face in opposite directions.

23. An electrical apparatus, comprising an electrical device containing circuitry, plural electrical contact means directly mounted to such electrical device along a longitudinal axis thereof for mechanically connecting and electrically connecting said electrical device with another member, each electrical contact means including a base and a contacting portion, said contacting portion including a resilient cantilever arm protruding from said base and a curved contacting surface area at the distal end of said cantilever arm for contacting with an external member inserted to resilient engagement therewith, said electrical contact means imparting a net moment substantially equal to zero on said electrical device about an axis parallel to said longitudinal axis when in said connected relation, and wherein said contact means comprise trifurcated contacts having three cantilever arms extending generally in parallel and contacting portions on each cantilever arm.

24. The apparatus of claim 23, wherein the contacting portions of the pair of outer cantilever arms face in one direction and the contacting portion of the center cantilever arm faces in the relatively opposite direction.

25. An electrical apparatus, comprising an electrical device containing circuitry, plural electrical contact means mounted to said electrical device for mechanically connecting and electrically connecting said electrical device with another member, each electrical contact means including a base and a contacting portion, said contacting portion including a cantilever arm protruding from said base and a curved contacting surface area at the distal end of said cantilever arm for contacting with an external member inserted to engagement therewith, said electrical contact means comprising trifurcated contacts having three cantilever arms extending generally in parallel and contacting portions on each cantilever arm, each said electrical contact means imparting a net moment substantially equal to zero on said electrical device when in said connected relation, wherein the contacting portions of the pair of outer cantilever arms face in one direction and the contacting portion of the center cantilever arm faces in the relatively opposite direction, and wherein the center contact is wider than the outer two contacts.

26. An electrical apparatus, comprising an electrical device containing circuitry, plural electrical contact means mounted to said electrical device for mechanically connecting and electrically connecting said electrical device with another member, each electrical contact means including a base and a contacting portion, said contacting portion including a cantilever arm protruding from said base and a curved contacting surface area at the distal end of said cantilever arm for contacting with an external member inserted to engagement therewith, said electrical contact means comprising trifurcated contacts having three cantilever arms extending generally in parallel and contacting portions on each cantilever arm, each said electrical contact means imparting a net moment substantially equal to zero on said electrical device when in said connected relation, wherein the contacting portions of the pair of outer cantilever arms face in one direction and the contacting portion of the center cantilever arm faces in the relatively opposite direction, and wherein the force created by bending the center cantilever arm is about the same as the force created by bending of both the outer cantilever arms.

27. A trifurcated electrical contact, comprising a base and a contacting portion, said contacting portion including at least three cantilever arms protruding from said base and extending generally in parallel, and a curved contacting surface area at the distal end of each of said cantilever arms for contacting with an external member inserted to engagement therewith, and wherein the contacting portions of at least two cantilever arms face in one direction and the contacting portion of a cantilever arm located between said at least two cantilever arms faces in the opposite direction, and wherein the center cantilever arm is wider than the outer two cantilever arms.

28. An electrical interconnection system, comprising two substantially identical electrical connectors, each including electrical contact means for making an electrical connection, and housing means for supporting said electrical contact means, said housing means having guiding means for guiding the housing means into aligned coupled relation with the housing means of the other electrical connector to place the respective electrical contact means of said respective electrical connectors in electrical connecting relation, said electrical contact means imparting on said housing means a net moment substantially equal to zero when in said electrical connecting relation, said electrical contact means comprising plural electrical contacts arranged in a row, each contact including a base and a contacting portion, said contacting portion including a cantilever arm protruding from said base and a curved contacting surface area at the distal end of said cantilever arm for contacting with a contact of similar configuration, said curved contacting surface area of respectively adjacent electrical contacts facing in respectively opposite directions, and said contacts comprising bifurcated contacts having a pair of cantilever arms extending generally in parallel and contacting portions on each cantilever arm.

29. The connector of claim 28, wherein the contacting portions of the pair of cantilever arms respectively face in opposite directions.

30. An electrical interconnection system, comprising two substantially identical electrical connectors, each including electrical contact means for making an electrical connection, and housing means for supporting said electrical contact means, said housing means having guiding means for guiding the housing means into aligned coupled relation with the housing means of the other electrical connector to place the respective electrical contact means of said respective electrical connectors in electrical connecting relation, said electrical contact means imparting on said housing means a net moment substantially equal to zero when in said electrical connecting relation, said electrical contact means comprising plural electrical contacts arranged in a row, each contact including a base and a contacting portion, said contacting portion including a cantilever arm protruding from said base and a curved contacting surface area at the distal end of said cantilever arm for contacting with a contact of similar configuration, said curved contacting surface area of respectively adjacent electrical contacts facing in respectively opposite directions, and said contacts comprising trifurcated contacts having three cantilever arms extending generally in parallel and contacting portions of each cantilever arm.

31. The connector of claim 30, wherein the contacting portions of the pair of outer cantilever arms face in one direction and the contacting portion of the center cantilever arm faces in the relatively opposite direction.

32. The connection of claim 31, wherein the force created by the center cantilever arm when in connected relation is about the same in magnitude although opposite in direction as the total force created by the outer cantilever arms.

* * * * *